US010504673B2

(12) United States Patent
Cha

(10) Patent No.: US 10,504,673 B2
(45) Date of Patent: Dec. 10, 2019

(54) SWITCH DEVICE COMPRISING TWO SWITCHES WHICH SHARE A COMMON CONDUCTOR

(71) Applicant: LG ELECTRONICS INC., Seoul (KR)

(72) Inventor: Jungmin Cha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/133,852

(22) Filed: Sep. 18, 2018

(65) Prior Publication Data

US 2019/0096609 A1 Mar. 28, 2019

(30) Foreign Application Priority Data

Sep. 22, 2017 (KR) ..... 10-2017-0122449
Nov. 28, 2017 (KR) ..... 10-2017-0161027

(51) Int. Cl.
*H01H 19/46* (2006.01)
*H01H 19/50* (2006.01)
(Continued)

(52) U.S. Cl.
CPC ..... *H01H 19/46* (2013.01); *F24C 3/103* (2013.01); *F24C 3/12* (2013.01); *F24C 3/126* (2013.01); *H01H 1/585* (2013.01); *H01H 3/0206* (2013.01); *H01H 19/025* (2013.01); *H01H 19/14* (2013.01); *H01H 19/50* (2013.01);
(Continued)

(58) Field of Classification Search
CPC ..... H01H 13/12; H01H 19/00; H01H 19/001; H01H 19/42; H01H 19/46; H01H 19/50; H01H 19/54; H01H 19/60; H01H 21/54; H01H 2203/034; H01H 2231/012; H01H 2225/01
See application file for complete search history.

(56) References Cited

U.S. PATENT DOCUMENTS 5,008,498 A 4/1991 Yamazaki
5,581,059 A * 12/1996 Chang ..... H01H 19/46 200/11 G
(Continued)

FOREIGN PATENT DOCUMENTS

WO WO 2011/084729 7/2011

OTHER PUBLICATIONS

European Search Report dated Feb. 19, 2019 issued in Application No. 18195334.0.

*Primary Examiner* — Vanessa Girardi
(74) *Attorney, Agent, or Firm* — Ked & Associates LLP

(57) ABSTRACT

A switch device and a cooking device having a switch device. The switch device may include a first switch configured to be opened or closed based on contact or non-contact between the first blade and the second blade; a second switch configured to be opened and closed based on contact or non-contact between the third blade and the fourth blade; a housing that accommodates the first switch and the second switch therein; and an actuator disposed in the housing and actuated to selectively open and close the first switch and the second switch. The first switch and the second switch may be fixedly supported by a support structure disposed on a same plane as a mounting plane for the actuator and may be positioned in a single inner space.

19 Claims, 22 Drawing Sheets

(51) Int. Cl.

| | |
|---|---|
| ***H01H 19/02*** | (2006.01) |
| ***H01H 19/14*** | (2006.01) |
| ***F24C 3/12*** | (2006.01) |
| ***F24C 3/10*** | (2006.01) |
| ***H01H 1/58*** | (2006.01) |
| ***H01H 3/02*** | (2006.01) |
| ***H01H 19/62*** | (2006.01) |

(52) U.S. Cl.
CPC ..... *H01H 19/62* (2013.01); *H01H 2203/034* (2013.01); *H01H 2225/01* (2013.01); *H01H 2225/018* (2013.01); *H01H 2231/012* (2013.01)

(56) References Cited

U.S. PATENT DOCUMENTS

| | | | | |
|---|---|---|---|---|
| 5,601,183 | A * | 2/1997 | Boyd | H01H 1/56 200/339 |
| 5,728,982 | A * | 3/1998 | Rao | H01H 19/08 200/11 G |
| 7,148,440 | B2 | 12/2006 | Gjerde | |
| 7,858,890 | B2 * | 12/2010 | Huang | H01H 19/06 200/302.1 |
| 8,173,924 | B2 | 5/2012 | Tegel et al. | |
| 2009/0277761 | A1 | 11/2009 | Huang et al. | |
| 2012/0247452 | A1 | 10/2012 | Pianezze | |

* cited by examiner

SWITCH DEVICE COMPRISING TWO SWITCHES WHICH SHARE A COMMON CONDUCTOR

CROSS-REFERENCE TO RELATED APPLICATION(S)

This application claims the priority of Korean Patent Application No. 10-2017-0122449 filed in Korea on Sep. 22, 2017 and Korean Patent Application No. 10-2017-0161027 filed in Korea on Nov. 28, 2017, in the Korean Intellectual Property Office, the disclosure of which is hereby incorporated by reference in its entirety.

BACKGROUND

1. Field

A switch device and a cooking appliance including a switch device are disclosed herein.

2. Background

Electric switches with rotatable rotors may be used in a variety of applications in a variety of cooking appliances. For example, an electrical switch with a rotatable rotor may be used as a switch to control a burner ignition-circuit in a cooking appliance that uses gas as fuel.

The electrical switch for the cooking appliance may be installed in a manner such that it is coupled to a valve stem rotatably connected to a gas valve. The rotor of the electrical switch may be rotated together with the valve stem which is rotated when a knob connected to the valve stem is rotated.

When the valve stem is rotated to open the valve to activate gas supply, the burner ignition-circuit is activated to ignite the gas supplied to the burner. With this configuration, the rotor of the electrical switch is rotated together with the valve stem. The electrical switch allows rotation of the rotor to be involved in activation of the burner ignition-circuit.

Typically, the electrical switch used as a switch for controlling the burner ignition-circuit of the cooking appliance includes a rotor in the form of a cam and a pair of contact blades. In this case, when the pair of contact blades are separated from each other, the burner ignition-circuit may be inactivated. When the pair of contact blades touch each other, the burner ignition-circuit may be activated.

When the valve stem is rotated to open the valve, the rotor is rotated together with the valve stem to allow the pair of contact blades in a non-contact state to contact each other. With this configuration, an electrical connection between the pair of the contact blades may be achieved by pressing one of the pair of contact blades so that contact is made between the pair of contact blades.

An electrical switch with this configuration may be used for only a single circuit. When various circuits are used in order to provide various functions, a plurality of electric switches is required for switching various circuits respectivley.

In order to improve the safety of the cooking appliance and to enhance the user's convenience, the cooking appliance in which the electric switch is used may require a multi-switching function by which various circuits are switched via actuation of a same rotational axis. For example, when an indicator for indicating that the valve is open is provided on the cooking appliance, the user may easily know from the indicator light that the valve is open. The turn-on and turn-off of the indicator will be closely related to the opening or closing of the valve. Therefore, switching of the circuit for turn-on and turn-off of the indicator is preferably performed via the rotation of the valve stem.

That is, in the cooking appliance, a multi-switching function may be required in which the switching of the burner ignition-circuit and the switching of the turn-on/off circuit of the indicator lamp are performed together with the rotation of the valve stem.

However, in order to realize the multi-switching function by using the electric switch as described above, a first electric switch for switching the burner ignition-circuit and a second electric switch for switching the turn-on/off circuit of the indicator lamp are separately required. That is, in order to implement the multi-switching function using the above-described electric switch, the number of electric switches to be installed in the cooking operation must be increased as the number of circuits to be subjected to the switching operation increases. This increases a number of wires connected to a switch, complicates a structure of the switch, increases an overall volume of the switch, and increases manufacturing costs of a cooking appliance in which the switch is installed.

BRIEF DESCRIPTION OF THE DRAWINGS

Embodiments will be described in detail with reference to the following drawings in which like reference numerals refer to like elements, and wherein.

DETAILED DESCRIPTION

Figure 1:
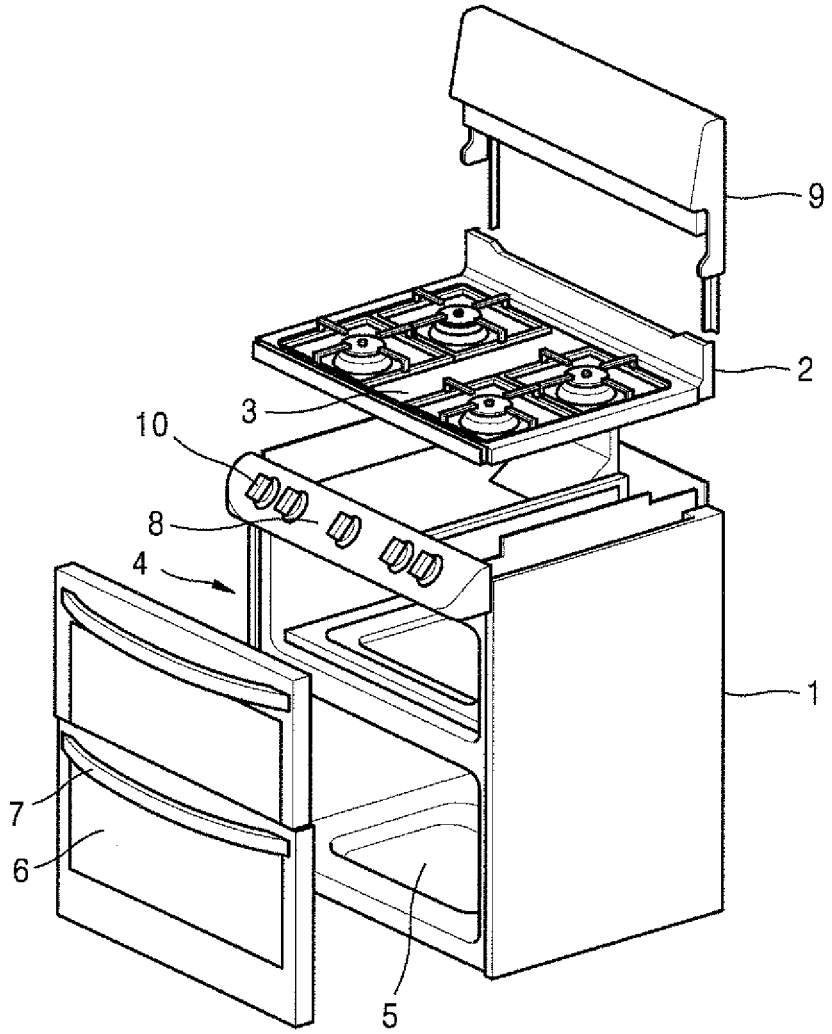
FIG. 1 is a perspective view of a cooking appliance according to an embodiment.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The same reference numbers in different figures may denote the same or similar elements, and as such may perform similar functionality. Further, descriptions and details of well-known steps and elements are omitted for simplicity of the description. Furthermore, in the following detailed description, numerous specific details are set forth in order to provide a thorough understanding. However, it will be understood that embodiments may be practiced without these specific details. In other instances, well-known methods, procedures, components, and circuits have not been described in detail so as not to unnecessarily obscure aspects.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present, In addition, it will also be understood that when an element or layer is referred to as being "between" two elements or layers, it can be the only element or layer between the two elements or layers, or one or more intervening elements or layers may also be present.

The terminology used herein is for describing particular embodiments only and is not intended to be limiting of the present disclosure. As used herein, the singular forms "a" and "an" are intended to include the plural forms as well, unless the context clearly indicates otherwise. It will be further understood that the terms "comprise", "comprising", "include", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
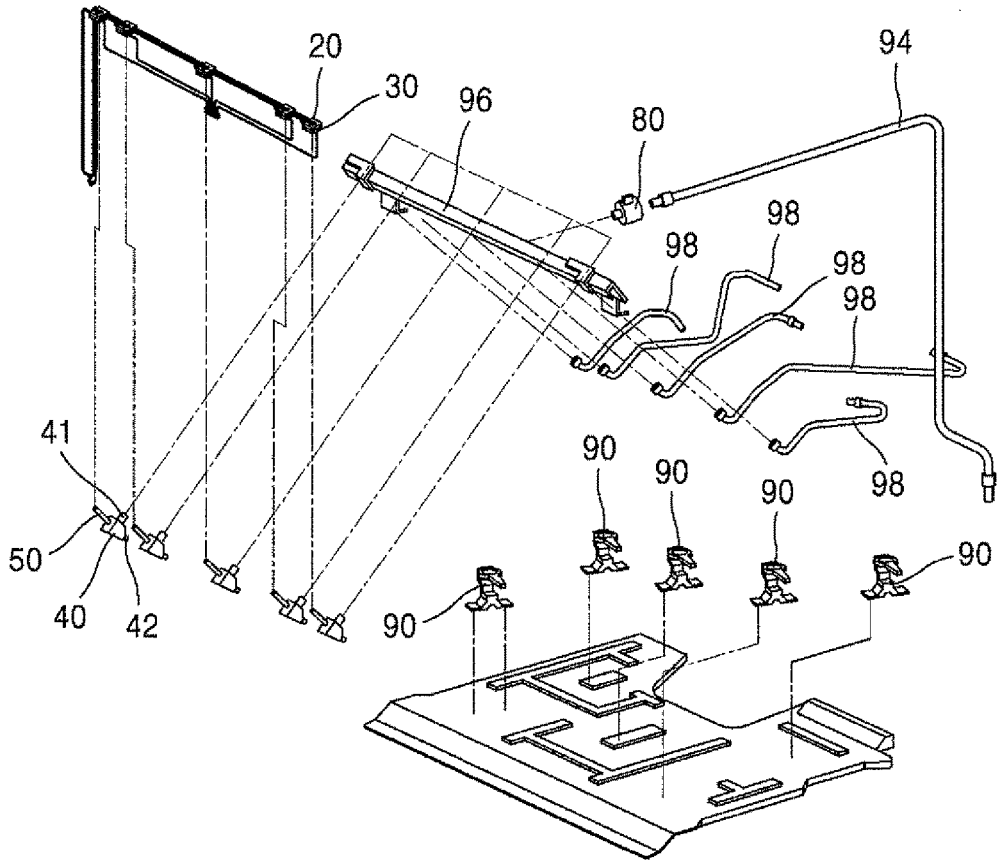
FIG. 2 is an exploded perspective view schematically illustrating the cooking appliance shown in FIG. 1.

FIG. 1 is a perspective view of a cooking appliance according to an embodiment. FIG. 2 is an exploded perspective view schematically illustrating the cooking appliance shown in FIG. 1.

Referring to FIG. 1 and FIG. 2, a cooking appliance according to an embodiment may include a body 1 defining an appearance thereof. The body 1 may be formed in a substantially rectangular parallelepiped shape. The body 1 may be made of a material having a predetermined strength to protect a plurality of components installed in an inner space thereof.

On a top of the body 1, a cook-top unit or cook-top 2 may be provided to heat food or other items (hereinafter "food") placed on a top thereof, or a container containing the food therein disposed thereon to cook the food. The cook-top 2 may include a loading plate 3 that supports food to be cooked, or a container containing the food. The loading plate 3 may define a top portion of the cook-top 2.

The container containing food or food to be cooked may be loaded on the loading plate 3. Below the loading plate 3, at least one burner 90 may be provided that heats the container containing the food or food to be cooked.

Below the cook-top 2, an oven unit or oven 4 may be provided. In an interior space of the oven 4, a cooking chamber 5 defining a food cooking space may be disposed. The cooking chamber 5 may have a hexahedral shape with an open front. When a front face of the cooking chamber 5 is blocked or closed, the interior space in the cooking chamber 5 may be heated to cook the food. That is, the interior space in the cooking chamber 5 in the oven 4 may serve as a space where food is cooked.

An upper heater may be provided above the cooking chamber 5 so as to supply heat downward toward the interior space of the cooking chamber 5. Below the cooking chamber 5, a lower heater may be provided which applies heat upwards towards the interior space of the cooking chamber 5.

Further, a convection unit that heats the interior space of the cooking chamber 5 via convection of hot air may be provided at a rear of the cooking chamber 5. The convection unit may heat the air in the interior space of the cooking chamber 5 and forcibly cause the heated air to flow so as to heat the interior space of the cooking chamber 5. This ensures that the food located in the interior space of the cooking chamber 5 is heated uniformly.

The oven 4 may include a door 6 that selectively opens and closes the cooking chamber 5. The door 6 may be pivotably provided.

The door 6 may have a generally hexahedral shape with a predetermined thickness. A handle 7 may be mounted on the door 6. A user may grasp the handle 6 when the user wishes to pivot the door 6. By using the handle 7, the user may easily pivot the door 6.

A control panel 8 may be provided on or at a front of the cook-top 2, and above the door 6. On the control panel 8, there may be disposed a plurality of knobs 10, which may be manipulated by a user, to control ignition and thermal power of each burner 90. Each knob 10 may operate via rotation by the user around an axis of rotation which may be a central axis thereof. However, an operation scheme of the knob is not limited to the rotation type.

In this embodiment, five burners 90 are provided. Correspondingly, an example in which five knobs 10 and five valves 40 are respectively provided is illustrated. Each of the five knobs 10 as shown in FIG. 1 may being fixedly fitted with a rotational shaft 50 of the valve 40 passing through the control panel 8. When the knob 10 is rotated, the rotational shaft 50 may rotate together with the knob 10. In this way, whether or not the valve 40 is opened and closed, and a degree of opening thereof may be determined.

Within the control panel 8, the rotational shaft 50 may be inserted into a switch device 100. An example of the structure of the switch device 100 will be described hereinafter.

The cook-top 2 may accommodate therein a gas input pipe 94 a first end of which may be connected to an external gas pipe to supply gas to each burner 90. A second end of the gas input pipe 94 may be connected to a gas distribution pipe 96. A governor valve 80 may be provided at the gas input pipe 94 to control whether the gas is to be supplied to the cook-top 2. In FIG. 2, the governor valve 80 is shown to be positioned at the second end of the gas input pipe 4. However, the position of the governor valve is not necessarily limited thereto.

The gas distribution pipe 96 may be connected to all of first connectors 41 of the valves 40. The gas supplied from the gas input pipe 94 may be supplied from the gas distribution pipe 96 to each of the valves. A second connector 42 of the valve 40 may be connected to a first end of an individual pipe 98. A second end of the individual pipe 98 may be connected to a corresponding burner 90.

A control unit or controller 9 may be equipped with electrical components that control operations of the oven 4 and cook-top 2 and control power supply thereto and display operation information thereof.

Figure 3:
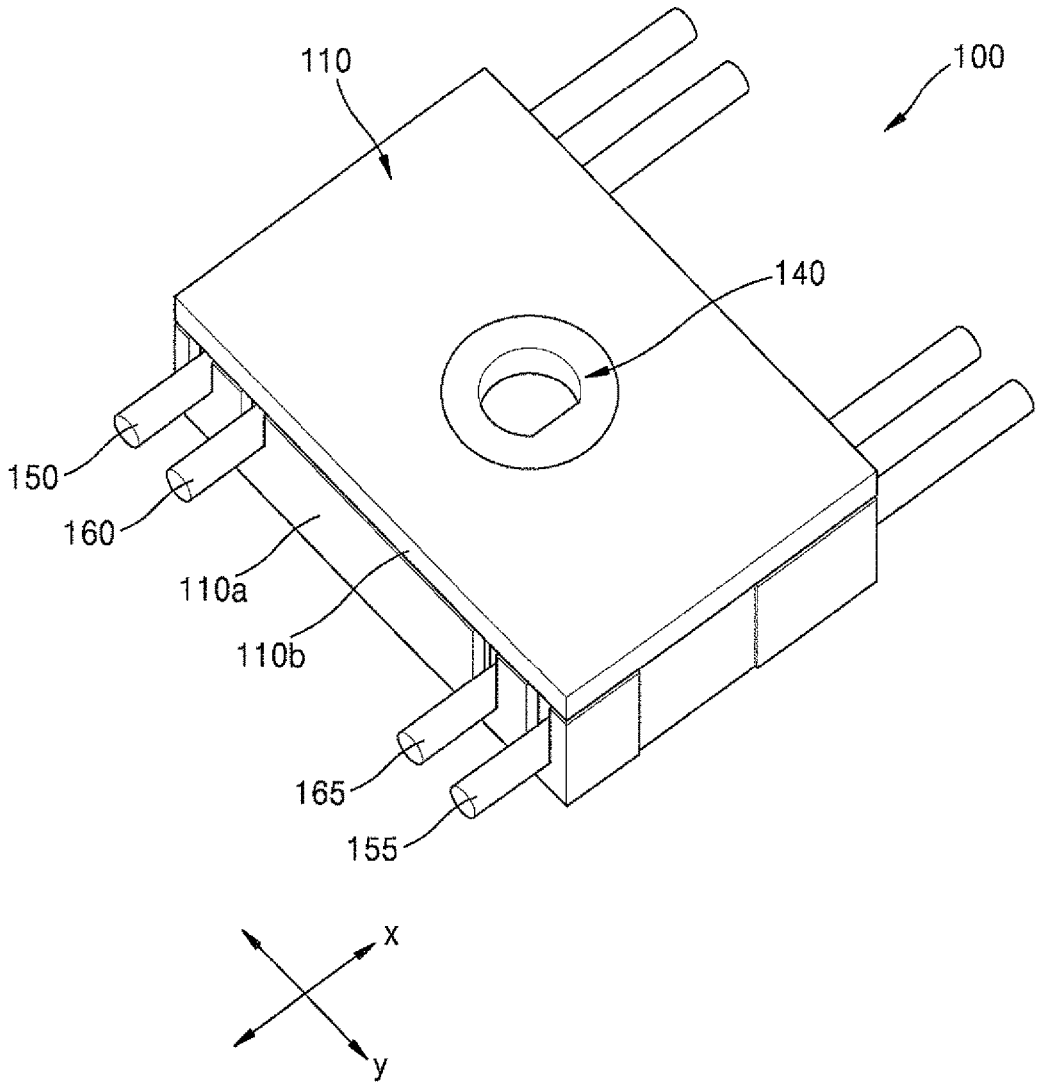
FIG. 3 is a perspective view of a switch device according to an embodiment.
Figure 4:
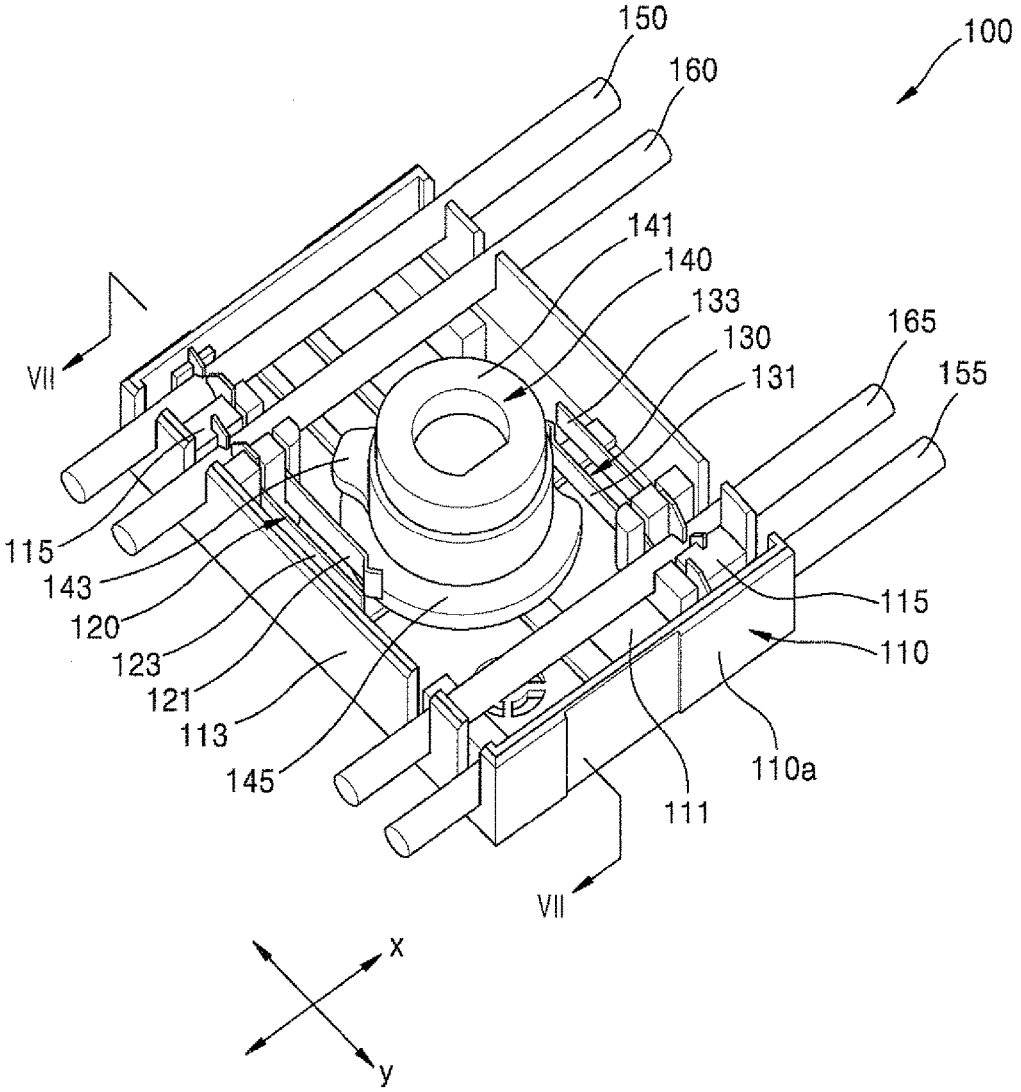
FIG. 4 is a perspective view showing an internal structure of the switch device as shown in FIG. 3.

FIG. 3 is a perspective view of a switch device according to an embodiment. FIG. 4 is a perspective view showing an internal structure of the switch device as shown in FIG. 3.

Referring to FIG. 3 and FIG. 4, the switch device 100 according to this embodiment may include a housing 110, a first switch 120, a second switch 130, and an actuator 140. The housing 110 may define the appearance of the switch device 100. The housing 110 may have a receiving space defined therein for receiving the first switch 120, the second switch 130, and the actuator 140 therein.

In this embodiment, an example in which the housing 110 has a flat rectangular parallelepiped shape is illustrated. The housing 110 may include a combination of a first housing 110*a* and a second housing 110*b*, which may be removably assembled and arranged in a vertical direction. Further, the first housing 110*a* and the second housing 110*b* each may include a rectangular bottom face 111 and a sidewall 113 that extends upwardly from an outer edge of the bottom face 111 and surrounds the bottom face 111. The second housing 110*b* may be coupled to an open top of the first housing 110*a* to cover the open top of the first housing 110*a*. In this way, the receiving space may be defined.

Further, a central hole 112 may be formed in a central region of the bottom face 111. The actuator 140, which will be described hereinafter, may be installed at the central region of the bottom face 111 in which the central hole 112 is formed therein.

Conductors 150, 155, 160, and 165 may be laterally inserted in the housing 110. Each of the conductors 150, 155, 160, and 165 may include a core conductive wire of a highly conductive metal and an insulating cover material covering the conductive wire. Each of the conductors 150, 155, 160, and 165 may laterally penetrate the sidewall 113 of the housing 110.

The housing 110 may have a single inner space defined therein. The conductors 150, 155, 160, and 165 may extend through the single inner space of the housing 110. The conductors 150, 155, 160, and 165 may share the single inner space. The conductors 150, 155, 160, and 165 may be connected to the first switch 120 and the second switch 130, respectively, in the single inner space.

In this embodiment, an example in which four conductors 150, 155, 160, and 165 are installed in one switch device 100 is illustrated. In this example, a pair of common conductors 150 and 155, a first conductor 160, and a second conductor 165 are installed in the switch device 100 so as to pass through the single internal space of the housing 110.

In one example, around the central region of the bottom face 111 where the actuator 140 is installed, one of a pair of common conductors 150 and 155, that is, a first common conductor 150 and a first conductor 160 may be disposed at one or a first side of a first directional (Y) side. Further, the other or a second of the pair of common conductors 150 and 155, that is, the second common conductor 155 and the second conductor 165 may be disposed at the other or a second side of the first directional (Y) side.

That is, the actuator 140 may be disposed between a set of the first common conductor 150 and the first conductor 160 and a set of the second common conductor 155 and the second conductor 165. The first common conductor 150, the first conductor 160, the second common conductor 155, and the second conductor 165 may be arranged along a first direction, that is, the Y direction. Each of the first common conductor 150, the first conductor 160, the second common conductor 155, and the second conductor 165 may extend in a second direction, that is, the X direction.

The first switch 120 may include a first blade 121 and a second blade 123 which may be installed inside the housing 110 and separated from each other. The first switch 120 may be opened or closed based on contact or non-contact between the first blade 121 and the second blade 123. For example, the first switch 120 may be closed when contact is made between the first blade 121 and the second blade 123. When the first blade 121 and the second blade 123 are not in contact with each other, the first switch 120 may be opened.

One of the first blade 121 or the second blade 123 may be connected to the first common conductor 150, while the other of the first blade 121 or the second blade 123 may be connected to the first conductor 160. In this embodiment, an example is illustrated in which the first blade 121 is connected to the first common conductor 150 and the second blade 123 is connected to the first conductor 160.

The second switch 130 may include a third blade 131 and a fourth blade 133 disposed inside the housing 110 and separated from each other. The second switch 130 may be opened or closed based on contact or non-contact between the third blade 131 and the fourth blade 133. For example, the second switch 130 may be closed when contact is made between the third blade 131 and the fourth blade 133. The second switch 130 may be opened when the third blade 131 and the fourth blade 133 are not in contact with each other.

One of the third blade 131 or the fourth blade 133 may be connected to the second common conductor 155, while the other of the third blade 131 or the fourth blade 133 may be connected to the second conductor 165. In this embodiment, an example is shown in which the third blade 131 is connected to the second common conductor 155 and the fourth blade 133 is connected to the second conductor 165.

The actuator 140 may be installed in the housing 110 to selectively open and close the first switch 120 and the second switch 130. The actuator 140 may include a rotatable body 141, a first protrusion 143, and a second protrusion 145. The rotatable body 141 may be formed in a substantially cylindrical shape and be rotatably installed in the central region of the bottom face 111 having the central hole 112 formed therein.

The first protrusion 143 may be formed to protrude from the rotatable body 141. The first protrusion 143 may protrude from an outer circumferential surface of the rotatable body 141 toward the first switch 120. The first protrusion 143 may be displaced in conjunction with rotation of the rotatable body 141. The first protrusion 143 may press the first switch 120 at a position in contact with the first switch 120 such that the first blade 121 and the second blade 123 are in contact with each other.

According to this embodiment, as for the first switch 120, the second blade 123 may be positioned closer to the actuator 140 than the first blade 121. Further, the second blade 123 may be positioned such that at least a portion of the second blade 123 is within a displacement range of the first protrusion 143. That is, as viewed from the open top of the first housing 110*a* toward the bottom face of the first housing 110*a*, the second blade 123 may extend along a region between an outer surface of the rotatable body 141 and an end of the first protrusion 143 protruding therefrom.

When the first blade 121 and the second blade 123 are positioned in this manner, the first protrusion 143 may be displaced via rotation of the rotatable body 141 to contact the first switch 120 and contact the second blade 123 and press the second blade 123 toward the first blade 121. Then, when the second blade 123 presses against the first blade 121, the contact between the second blade 123 and the first blade 121 is established. Thereby, electrical connection between the first blade 121 and the second blade 123 is made, such that the first switch 120 comes into a closed state.

Like the first protrusion 143, the second protrusion 145 may be formed to protrude from the rotatable body 141. The second protrusion 145 may protrude from the outer circumferential surface of the rotatable body 141 toward the second switch 130. The second protrusion 145 may press the second switch 130 such that the third blade 131 and the fourth blade 133 in contact each other.

According to this embodiment, for the first switch 120, the first blade 121 may be positioned closer to the actuator 140 than the second blade 123. Further, for the second switch 130, the third blade 131 may be positioned closer to the actuator 140 than the fourth blade 133.

When the third blade 131 and the fourth blade 133 are positioned in this manner, the second protrusion 145 may be displaced to contact the second switch 130 via rotation of the rotatable body 141. Then, the displaced second protrusion 145 may contact the third blade 131 and press the third blade 131 toward the fourth blade 133. Then, the third blade 131 may be pressed toward the fourth blade 133, such that the third blade 131 contacts the fourth blade 133. This allows an electrical connection between the third blade 131 and the fourth blade 133 to bring the second switch 130 into a closed state.

The first protrusion 143 and the second protrusion 145 may be formed to have different shapes. For example, radial protrusion dimensions of the first protrusion 143 and the second protrusion 145 may be configured differently based on respective distances between the first protrusion 143 and the second protrusion 145 and the first and second switches 120 and 130. Alternatively, contact positions or contact lengths between the first and second switches 120 and 130 and the first protrusion 143 and the second protrusion 145 respectively may be configured differently based on a degree of rotation of the actuator 140.

In this embodiment, when viewed from the open top of the first housing 110*a* toward the bottom face of the first housing 110*a*, the first switch 120 is positioned a greater distance from the actuator 140 than the second switch 130. Thus, the radial protrusion dimension of the first protrusion 143 is greater than the radial protrusion dimension of the second protrusion 145. With this configuration, the second protrusion 145 has a radially projecting dimension such that, upon displacement, the second protrusion 145 contacts the second switch 130 but not the first switch 120.

Further, in this embodiment, an example in which a circumferential dimension of the first protrusion 143 is smaller than a circumferential dimension of the second protrusion 145 is illustrated. In this case, when rotation of the actuator 140 is performed, a contact region between the second protrusion 145 and the second switch 130 may be larger than a contact region between the first protrusion 143 and the first switch 120.

In addition, the first protrusion 143 and the second protrusion 145 may be positioned at different levels along the vertical direction of the rotatable body 141. That is, the first protrusion 143 and the second protrusion 145 may have different vertical distances from the bottom face 111 of the first housing 110*a*.

In this embodiment, an example where the first protrusion 143 is positioned farther from the bottom face of the first housing 110*a* than the second protrusion 145 is exemplified. Accordingly, one of the first blade 121 or the second blade 123 which is disposed closer to the actuator 140 than the other may be positioned farther from the bottom face 111 of the first housing 110*a* than the third blade 131 and the fourth blade 133. Hereinafter, a distance from the bottom face 111 of the first housing 110*a* is referred to as a vertical level.

Accordingly, a point of contact between the first protrusion 143 and the first switch 120 and a point of contact between the second protrusion 145 and the second switch 130 may be different from each other along the vertical direction of the rotatable body 141. That is, at a level relatively closer to the bottom face 111 of the first housing 110*a*, a first contact between the first protrusion 143 and the first switch 120 is made to open/close the first switch 120. More specifically, the first contact may be made between the first protrusion 143 and the first blade 121. On the other hand, at a level relatively far from the bottom face 111 of the first housing 110*a*, there is a second contact between the second protrusion 145 and the second switch 130 for opening and closing the second switch 130. More specifically, the second contact between the second protrusion 145 and the fourth blade 133 may be achieved.

Figure 5:
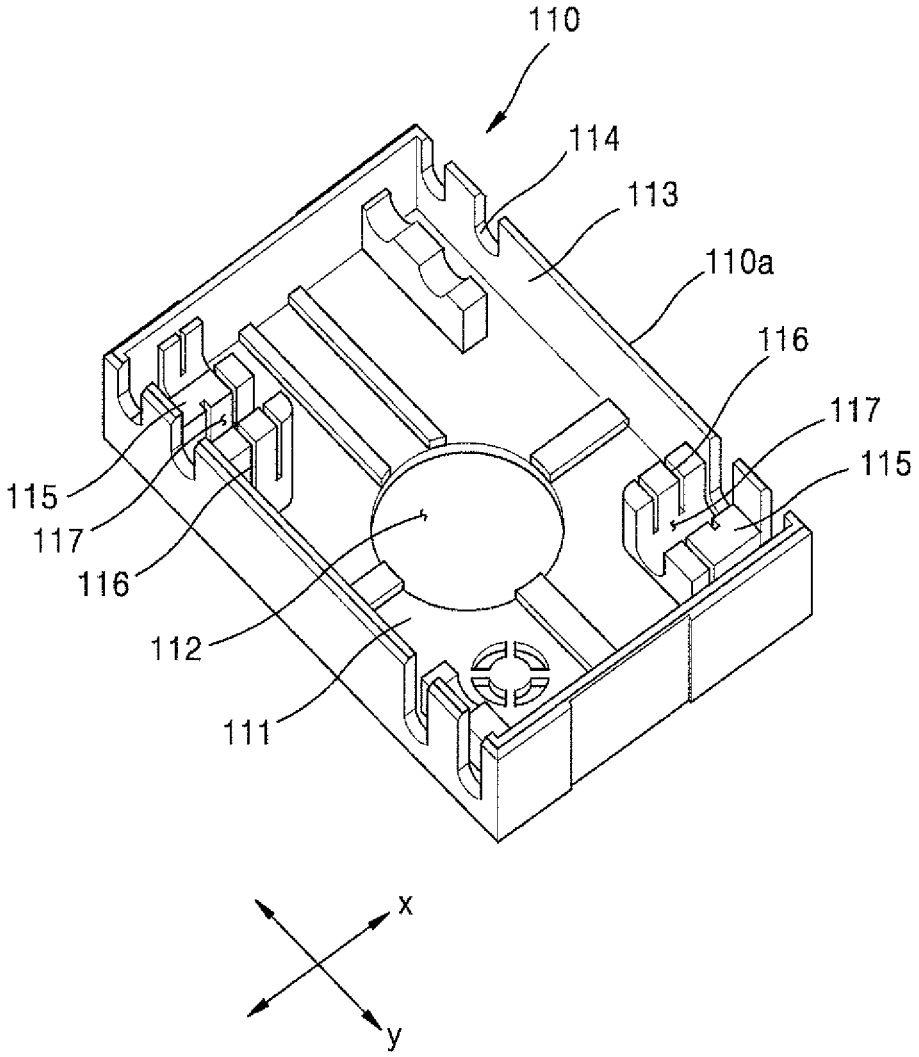
FIG. 5 is a perspective view showing an internal structure of a housing shown in FIG. 4.

FIG. 5 is a perspective view showing an internal structure of the housing shown in FIG. 4. Referring to FIG. 4 and FIG. 5, the housing 110 has a support structure. The support structure is provided for securing the first switch 120 and the second switch 130 within the housing 110. The support structure may protrude from the bottom face 111 of the housing 110.

In this embodiment, an example is shown in which the support structure is formed on the bottom face 111 of the first housing 110*a*. In another example, the support structure may be formed on the bottom face of the second housing 110*b*.

Hereinafter, an example in which the support structure is formed on the bottom face 111 of the first housing 110*a* is illustrated. However, embodiments are not be limited thereto.

According to this embodiment, the support structure may include support blocks 115 and slots 116. The support blocks 115 may protrude from the bottom face 111 of the first housing 110*a*. The support blocks 115 may be respectively disposed in the housing 110 at locations where contact between the first switch 120 and conductors 150 and 160 are made, and at locations where contact between the second switch 130 and the conductors 155 and 165 are made. Each support block 115 may have a generally rectangular parallelepiped shape; however, embodiments are not limited thereto.

The slots 116 may be respectively defined in support blocks 115. Each slot may define a cut-out along the first direction Y in each block. A number of the slots 116 may be equal to a number of the blades to be fixed to the support blocks 115. Each blade may be fixedly fitted in each slot 116. At least one of the first to third blades 121 to 133 may be inserted into the slot 116 and fixed to the support block 115.

In this embodiment, a pair of slots 116 is formed in each support block 115. The slots 116 may be arranged along the second direction X and spaced from each other at a predetermined space.

With this configuration, the second direction X may be defined as a direction parallel to the direction in which the conductors 150 and 155, 160 and 165 extend through the interior space of the housing 110. The first direction Y may be defined as a direction perpendicular to the second direction X on a plane parallel to the bottom face 111 of the first housing 110*a*.

The support blocks 115 may have conductor-receiving grooves 117 defined therein respectively. The common conductors 150 and 155, and the first conductor 160 and the second conductor 165 may be received in the conductor-receiving grooves 117 while passing through the support blocks 115.

In this embodiment, in the support structure formed for the first switch 120, a first pair of conductor-receiving grooves 117 are defined for receiving the first common conductor 150 and the first conductor 160. In the support structure formed for the second switch 130, a second pair of conductor-receiving grooves 117 are defined to accommodate the second common conductor 155 and the second conductor 165. With this configuration, a pair of conductor-receiving grooves 117 formed in each support structure is arranged spaced apart along the first direction y.

In addition, notches 114 may be defined in the sidewall 113 of the housing 110. The notches 114 may be defined through the sidewall 113. The notches 114 may define passages through which the common conductors 150 and 155, the first conductor 160, and the second conductor 165 pass through the housing 110.

According to this embodiment, a first long side wall of the four side walls defining the sidewall 113 has a number of notches 114 defined therein corresponding to the number of the conductors. The number of notches 114 corresponding to the number of conductors are defined in a second long side wall parallel to the first long side wall.

For example, four notches 114 may be defined in the first long side wall of the four side walls defining the sidewall 113, while four notches 114 may be defined in the second long side wall parallel to the first long side wall. The conductors 150 and 155, 160 and 165 may pass through the notches 114 in the sidewall 113 of the housing 110 and pass through the interior space of the housing 110.

The arrangement of the notches 114 in the sidewall 113 may be as follows: the notches 114 may be defined in a pair of first and second side walls parallel to each other, and thus, all of the conductors 150 and 155, 160 and 165 may pass through the single sidewall 113.

That is, all the conductors 150 and 155, 160 and 165 may be disposed within a single inner space of the single housing through the single sidewall 113. As a result, all of the blades 121, 123, 131, and 133 connected to the conductors 150 and 155, 160 and 165 may be disposed in the single inner space of the single housing.

Figure 6:
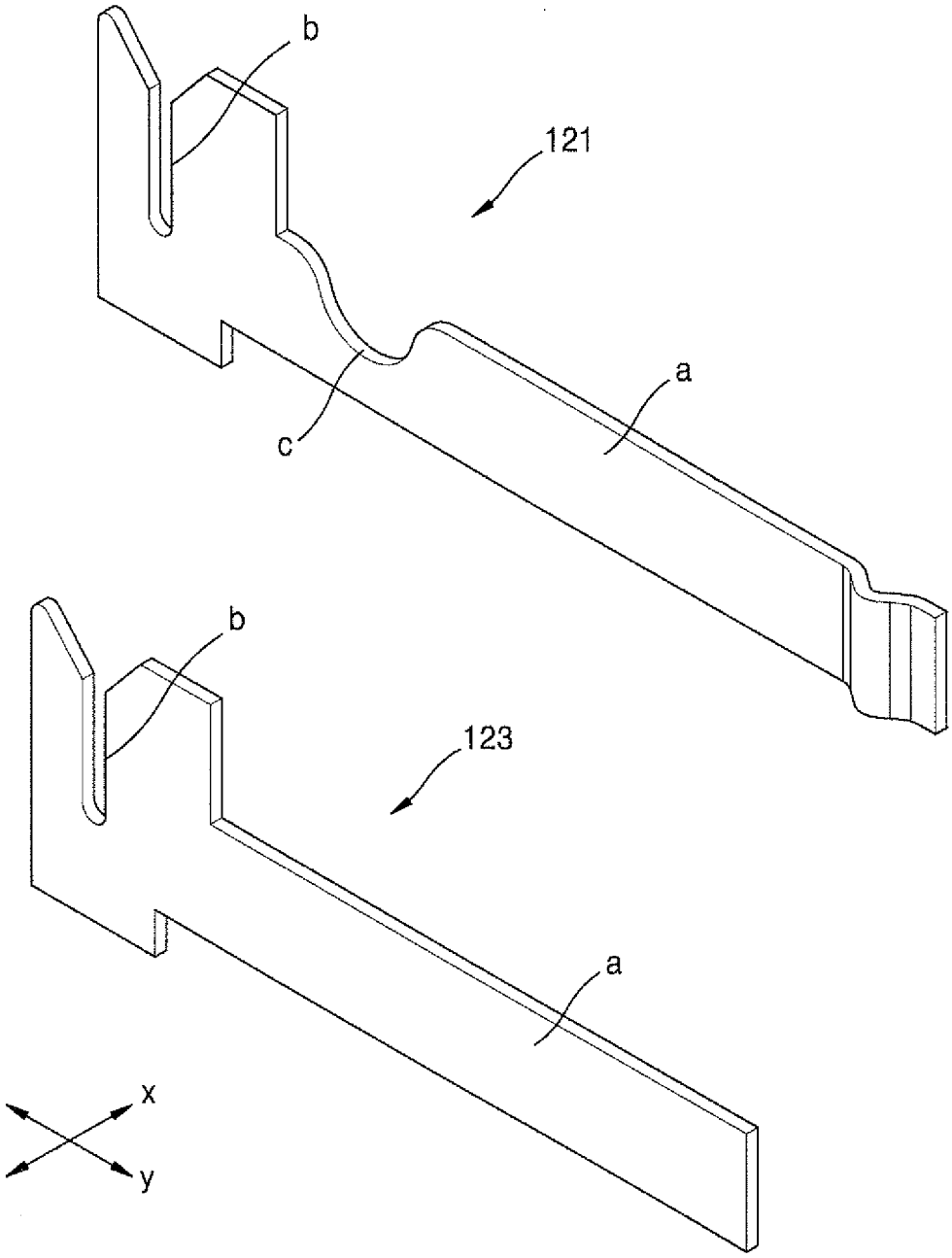
FIG. 6 is a perspective view of a separated state of each of a first blade and a second blade shown in FIG. 4.
Figure 7:
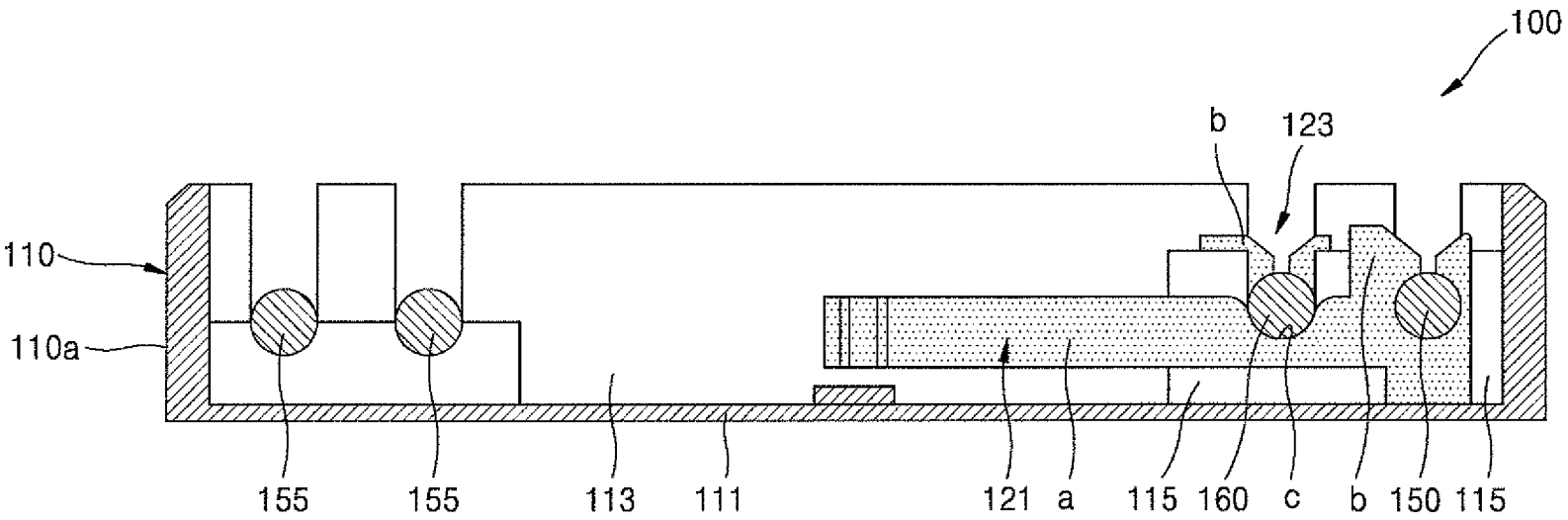
FIG. 7 is a cross-sectional view, taken along line VII-VII of FIG. 4.

FIG. 6 is a perspective view showing a separated state of each of first blade and second blade shown in FIG. 4. FIG. 7 is a cross-sectional view, taken along line VII-VII of FIG. 4.

Referring to FIGS. 4 and 7, at least one of the first blade 121 to the fourth blade 133 may include a blade body a, and a conductor-receiving portion b. In this embodiment, an example in which each of all of the blades 121, 123, 131, and 133 includes a blade body a, and a conductor-receiving portion b is illustrated.

Hereinafter, structure of each of the first blade 121 and the second blade 123 is exemplarily discussed.

The blade body a may be made of a highly conductive metal material and have a length extending in the first direction Y. The blade body a may be fitted in the slots 116, and thus, may be fixed to the support blocks 115, and be installed so as to be exposed to outside of the support blocks 115.

The conductor-receiving portion b may define one longitudinal direction end of the blade body a. When the blade body a is inserted in the slots 116 and is coupled to the support blocks 115, the conductor-receiving portion b may be configured be located at one of the pair of conductor-receiving grooves 117 defined in the support structure.

The conductor-receiving portion b may have a slit defined therein. A corresponding one of the conductors 150 and 155, 160 and 165 may be inserted into the slit of the conductor-receiving portion b. Engagement between the conductor-receiving portion b and the corresponding one of the conductors 150 and 155, 160 and 165 may be achieved. With this configuration, the conductor-receiving portion b may penetrate the insulating coating of the corresponding one of the conductors 150 and 155, 160 and 165 and may be in contact with the conductive wire hidden inside the insulating coating. Thereby, electrical connection between the conductors 150 and 155, 160 and 165 and the blades 121, 123, 131 and 133 may be established.

In addition, the blade body a may have a non-interference groove c defined therein. The non-interference groove c may prevent a conductor passing through the conductor-receiving groove 117 among the common conductors 150 and 155 and the first conductor 160 and the second conductor 165 from being interfering with the blade body a. In this embodiment, an example in which each of the first and second blades 121 and 131 connected to the first common conductor 150 and the second common conductor 155, which are located relatively far from the actuator 140 has the non-interference groove c is exemplified.

Each of the first blade 121 and the third blade 131 may be positioned such that the conductor-receiving groove b thereof is positioned in a conductor-receiving groove 117 disposed relatively away from the actuator 140 among a pair of conductor-receiving grooves 117 defined in each support structure. In this regard, the non-interference groove c may be defined in the blade body a of each of the first blade 121 and the third blade 131.

Further, the non-interference groove c is defined in the blade such that the non-interference groove c is positioned corresponding to a conductor-receiving groove 117 located relatively close to the actuator 140 among the pair of conductor-receiving grooves 117. For example, the non-interference groove c of the first blade 121 may be defined to coincide with the conductor-receiving groove 117 that receives the first conductor 160. The non-interference groove c of the third blade 131 may be defined to correspond with the conductor-receiving groove 117 receiving the second conductor 165.

As such, the first blade 121, which must be connected to the first common conductor 150 disposed relatively far from the actuator 140 as compared to the first conductor 160, may be installed at the same vertical level as the second blade 123 while avoiding interference with the first conductor 160 passing through an extension path of the first blade 121. In the same manner, the third blade 131, which must be connected to the second common conductor 155 disposed relatively far from the actuator 140 as compared to the second conductor 165, may be installed at the same vertical level as the fourth blade 133 while avoiding interference with the second conductor 165 passing through an extension path of the third blade 131.

In order for the actuation of the actuator 140 to achieve contact between the first blade 121 and the second blade 123 and contact between the third blade 131 and the fourth blade 133, it is necessary for the first blade 121 and the second blade 123 to be arranged at the same vertical level and the third blade 131 and the fourth blade 133 to be arranged at the same vertical level. In this regard, in this embodiment, the non-interference groove c is defined in each of the first and second blades 121 and 131, which are to be connected to the conductors located relatively far from the actuator 140 as compared to the conductors which are closer to the actuator 140. In this way, the first blade 121 and the second blade 123 may be arranged at the same vertical level. Further, the third blade 131 may be positioned at the same vertical level as the fourth blade 133.

Thus, each of the blades 121, 123, 131, and 133 may be fixed to the support structure disposed on a same plane as the plane on which the actuator 140 is installed. A pair of blades that are to contact each other may be arranged at the same vertical level. In this way, the switch device 100 may be configured such that the actuator 140, the first switch 120, and the second switch 130 may be installed in the single inner space within the single housing 110.

According to this embodiment, all of the components that constitute the switch device 100 are disposed in the single inner space of the single housing 110. More specifically, the actuator 140 is rotatably installed in the central region of the housing 110. The first switch 120 and the second switch 130 are disposed around the actuator 140. With this configuration, all of the first switch 120, the second switch 130, and the actuator 140 are disposed within the single inner space of the housing.

In the switch device 100, the first common conductor 150 and the first conductor 160 are connected to the first switch 120, and the second common conductor 155 and the second conductor 165 are coupled to the second switch 130. The conductors 150 and 155, 160 and 165 extend through the single sidewall 113 and are disposed within the single inner space. All of the conductors 150 and 155, 160 and 165 and the first switch 120 and the second switch 130 are disposed in the single inner space. In the single inner space, the conductors 150 and 155, 160 and 165 are connected to the corresponding blades 121, 123, 131 and 133.

There is a difference between the vertical level of the first blade 121 and the second blade 123, which constitute the first switch 120, and the vertical level of the third blade 131 and the fourth blade 133, which constitute the second switch 130. However, the vertical level difference is negligible compared to an overall vertical dimension of the housing 110. Thus, this difference does not act as a factor to prevent the first switch 120 and the second switch 130 from being positioned in the single inner space.

Figure 8:
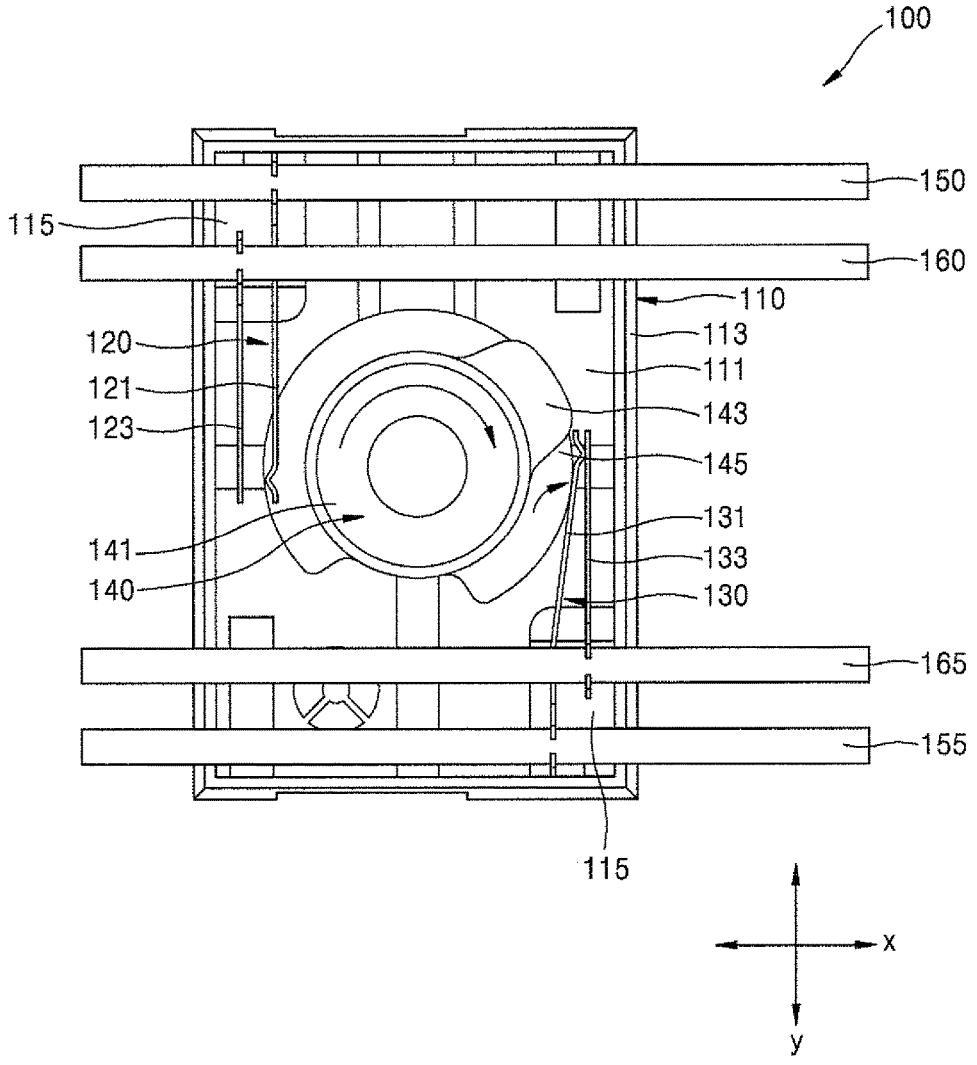
FIG. 8 shows an operating state of a second switch of the switch device as shown in FIG. 4.
Figure 9:
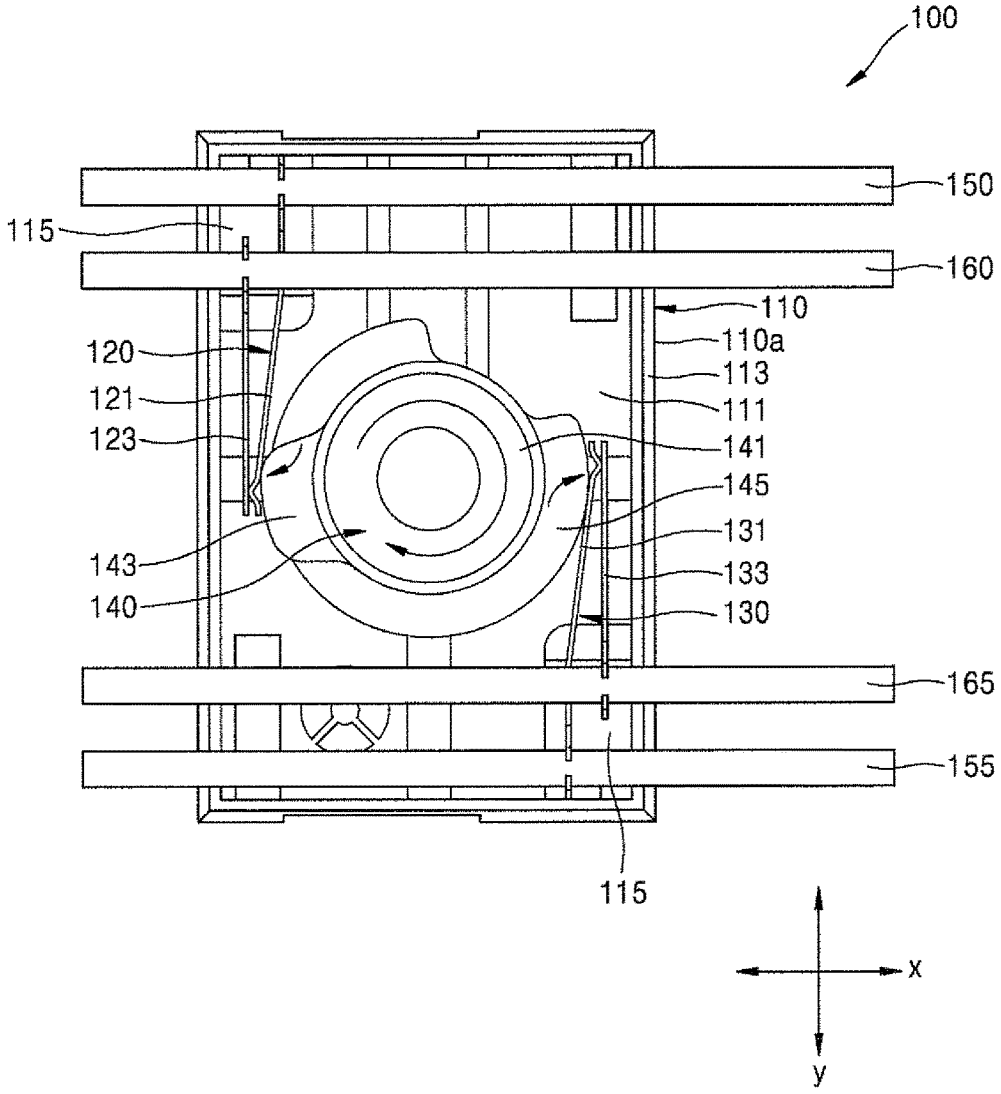
FIG. 9 shows operating states of a first switch and a second switch of the switch device as shown in FIG. 4.

FIG. 8 shows an operating state of the second switch of the switch device as shown in FIG. 4. FIG. 9 shows operating states of the first switch and the second switch of the switch device as shown in FIG. 4.

When the knob is rotated, the valve stem connected to the knob is rotated together with rotation of the knob to open the gas valve. Accordingly, gas supply to the burner is executed. Further, rotation of the valve stem allowing opening of the gas valve may result in rotation of the actuator 140, as shown in FIG. 8.

When the rotation of the actuator 140 is executed to a degree such that contact between the second protrusion 145 and the second switch 130 occurs, the second protrusion 145 presses the third blade 131 toward the fourth blade 133. As a result, the third blade 131 is bent toward the fourth blade 133, such that the third blade 131 and the fourth blade 133 contact each other. Thereby, an electrical connection is established between the third blade 131 and the fourth blade 133, so that the second switch 130 is closed. This results in an electrical connection between the second common conductor 155 and the second connector 165 of the second switch 130.

In this embodiment, the second switch 130 is connected to a display device or display 20 via the second common conductor 155 and the second conductor 165. The display 20 may be embodied as an indicator lamp which is turned on when the valve is opened.

With this configuration, when the valve stem is rotated to open the gas valve so that the supply of gas is started, the second switch 130 is closed and the display 20 is activated. This allows the user to know via the display 20 that the gas valve is open. When the display 20 is implemented as an indicator lamp, the user can easily determine, based on the indicator lamp being turned on, that the gas valve is open.

With the second switch 130 is closed, the rotation of the knob continues to ignite the burner. Thus, as shown in FIG. 9, when the rotation of the actuator 140 is made to an angle at which contact between the first protrusion 143 and the first switch 120 occurs, the first protrusion 143 presses the first blade 121 toward the second blade 123. As a result, the first blade 121 is bent toward the second blade 123 such that contact between the first blade 121 and the second blade 123 is established.

This results in an electrical connection between the first blade 121 and the second blade 123, which brings the first switch 120 to a closed state. In this way, an electrical connection between the first common conductor 150 and the first conductor 160 of the first switch 120 is established.

In this embodiment, the first switch 120 is exemplified as being connected to an ignition device 30 through the first common conductor 150 and the first conductor 160. With this configuration, the knob is rotated substantially to a maximum angle for the ignition of the burner while the gas is being supplied to the burner. In response, actuation of the actuator 140, resulting from the rotation of the valve stem connected to the knob, causes the first switch 120 to be closed.

In response, the ignition device 30 for igniting the gas supplied to the burner is activated. Thus, ignition of the burner may be executed.

While the knob is being turned, that is, while gas is being supplied to the burner, the second switch 130 may remain closed. On the other hand, the first switch 120 may be closed only during a portion of the continuous rotation period of the knob. That is, the switch device 100 may be configured such that in a state in which the knob is rotated for opening the valve, the tuned on state of the indicator lamp is continuously maintained, while the first switch 120 activated for ignition of the burner is closed only for a specific period.

To achieve this, in this embodiment, a circumferential extension dimension of the first protrusion 143 and a circumferential extension dimension of the second protrusion 145 may be set differently. For example, the second protrusion 145 may extend along a substantial portion of the circumferential dimension of the actuator 140. Conversely, the first protrusion 143 may extend along only a short portion of the circumferential dimension of the actuator 140. The first protrusion 143 may be located at a higher level than the second protrusion 145. When viewed from the open top of the first housing 110*a* toward the bottom face 111 of the first housing 110*a*an entirety of the first protrusion 143 may overlap the second protrusion 145.

Accordingly, in a state in which the knob 10 is rotated, the second switch 130 may be kept closed so that the turned-on state of the indicator lamp may be maintained continuously. The turned-on state of the indicator lamp may be maintained even when the first switch 120 is closed so that ignition of the burner is executed.

That is, operations of multiple functional units may be controlled using the single switch device 100. Operations of the multiple functional units controlled via the single switch device 100 may be performed simultaneously. Alternatively, the operations of the functional units may be performed at different timings.

Further, in this embodiment, the switch device 100 has the two switches 120 and 130. Thus, the switch device 100 is configured to control operations of two functional units. However, embodiments are not limited to this configuration. According to embodiments, the switch device 100 may have three or more switches. Thus, the single switch device may be configured to control operations of three or more functional units. That is, various modifications may be contemplated.

The switch device 100 according to this embodiment may be provided for a multi-switching function in which multiple circuits are switched by rotation of a single rotational shaft, that is, the single knob and the valve stem connected thereto. That is, embodiments may effectively provide for the multi-switching function using only one switch device instead of a plurality of switch devices.

Further, in the switch device 100 according to this embodiment, the plurality of switches 120 and 130 may be disposed in the single inner space defined in the single housing 110. Thus, a vertical stack of the switches 120 and 130 in order to realize the multi-switching function may not be required.

When the switches 120 and 130 are stacked in the vertical direction, respective structures for supporting the stacked switches 120 and 130 respectively need to be added. Therefore, a number of partitioning structures for dividing the internal space of the housing 110 in the vertical direction, corresponding to the number of the switches 120 and 130 should be added in the housing 110.

When the partitioning structures for partitioning the inner space of the housing 110 are added to the housing 110, the internal structure of the switch device 100 becomes complicated correspondingly. Further, a volume of the switch device 100 must be increased by a thickness occupied by the partitioning structures and a dimension of the vertical stack of the switches 120 and 130.

However, in the switch device 100 according to this embodiment, the plurality of switches 120 and 130 may be disposed within the single inner space of the single housing. Therefore, the switches 120 and 130 need not be stacked in the vertical direction in order to implement the multi-switching function. Accordingly, there is no need for the partitioning structures that divide the inner space of the housing 110 in the vertical direction, which may lead to a simple structure of the device.

That is, the switch device 100 according to this embodiment may be designed to have a simple structure without the partitioning structures for dividing the inner space of the housing 110 in the vertical direction. As a result, the switch device 100 according to this embodiment may have a compact structure, and may provide for a low manufacturing cost.

The switch device 100 of this embodiment may be manufactured at a low manufacturing cost while having a compact structure, and at the same time, may effectively provide for the multi-switching function. As a result, an increase in the manufacturing cost of the cooking appliance including the switch device 100 is suppressed. Further, an increase in volume occupied by the switch device 100 in the cooking appliance is suppressed. This may suppress an increase in the manufacturing cost of the cooking appliance due to the addition of the switch device. Control of operations of various functional units for convenient use of the cooking appliance may be executed effectively with the single switch device.

A switch device having such a configuration is merely one embodiment. Thus, various modifications may be made to the embodiment discussed above without departing from the scope.

Figure 10:
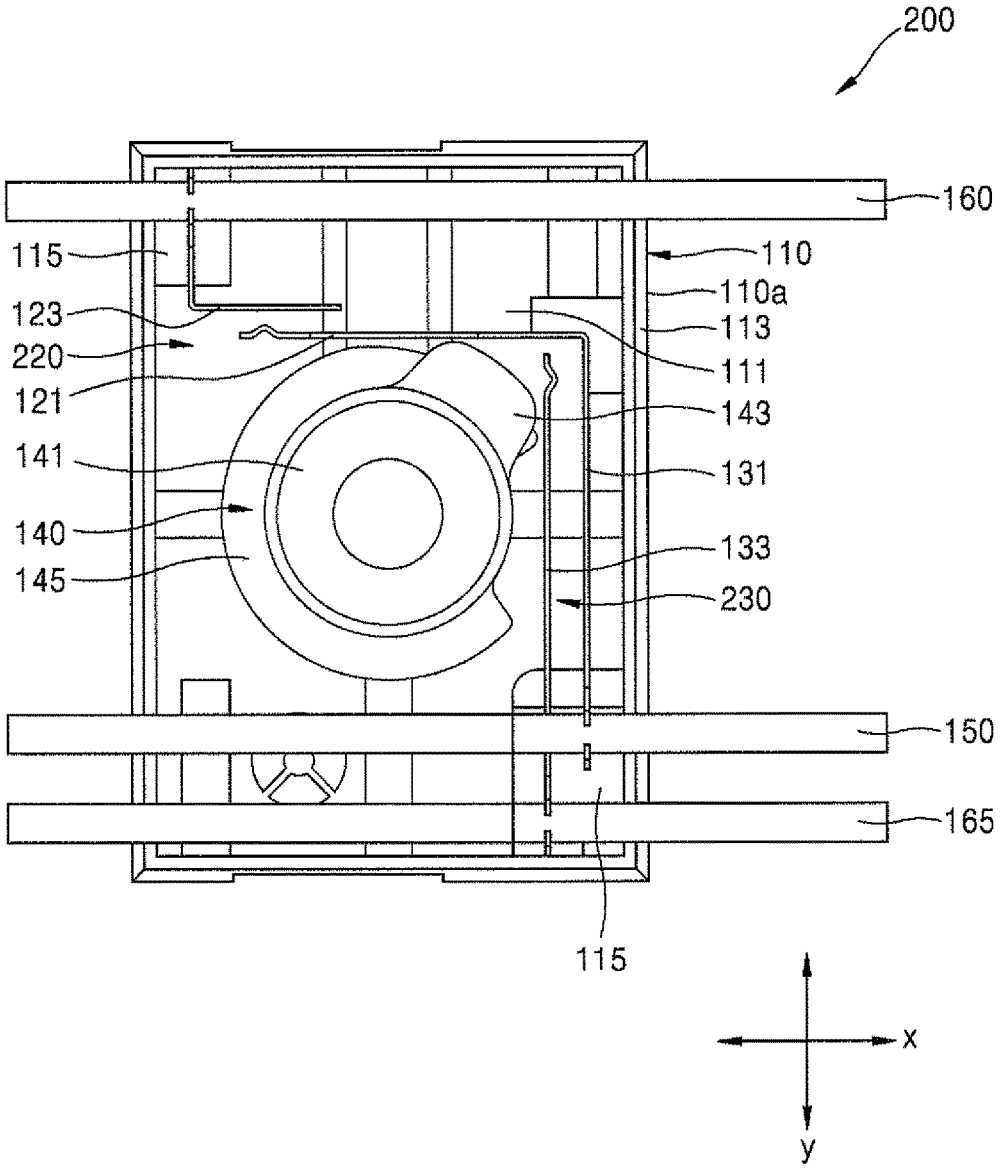
FIG. 10 is a perspective view showing an internal structure of a switch device according to another embodiment.
Figure 11:
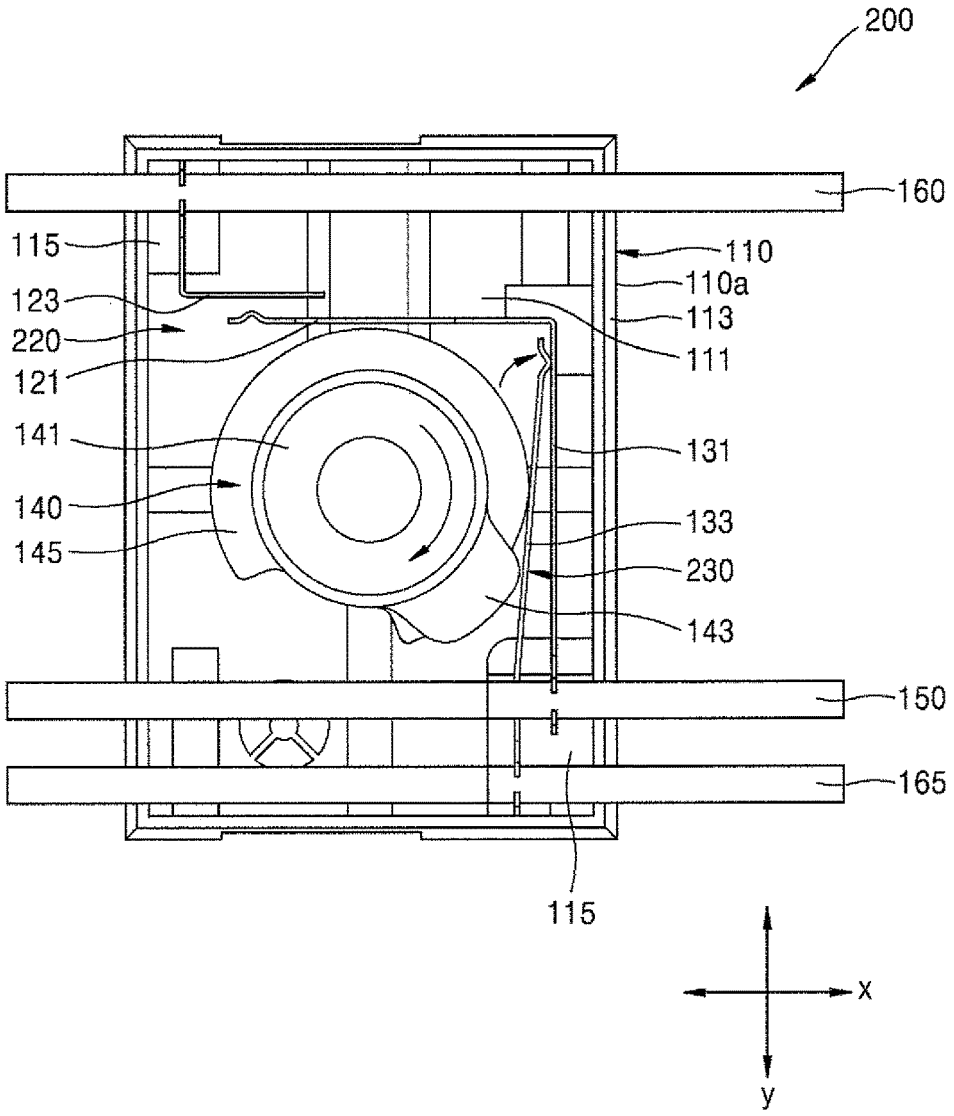
FIG. 11 shows an operating state of a second switch of the switch device as shown in FIG. 10.
Figure 12:
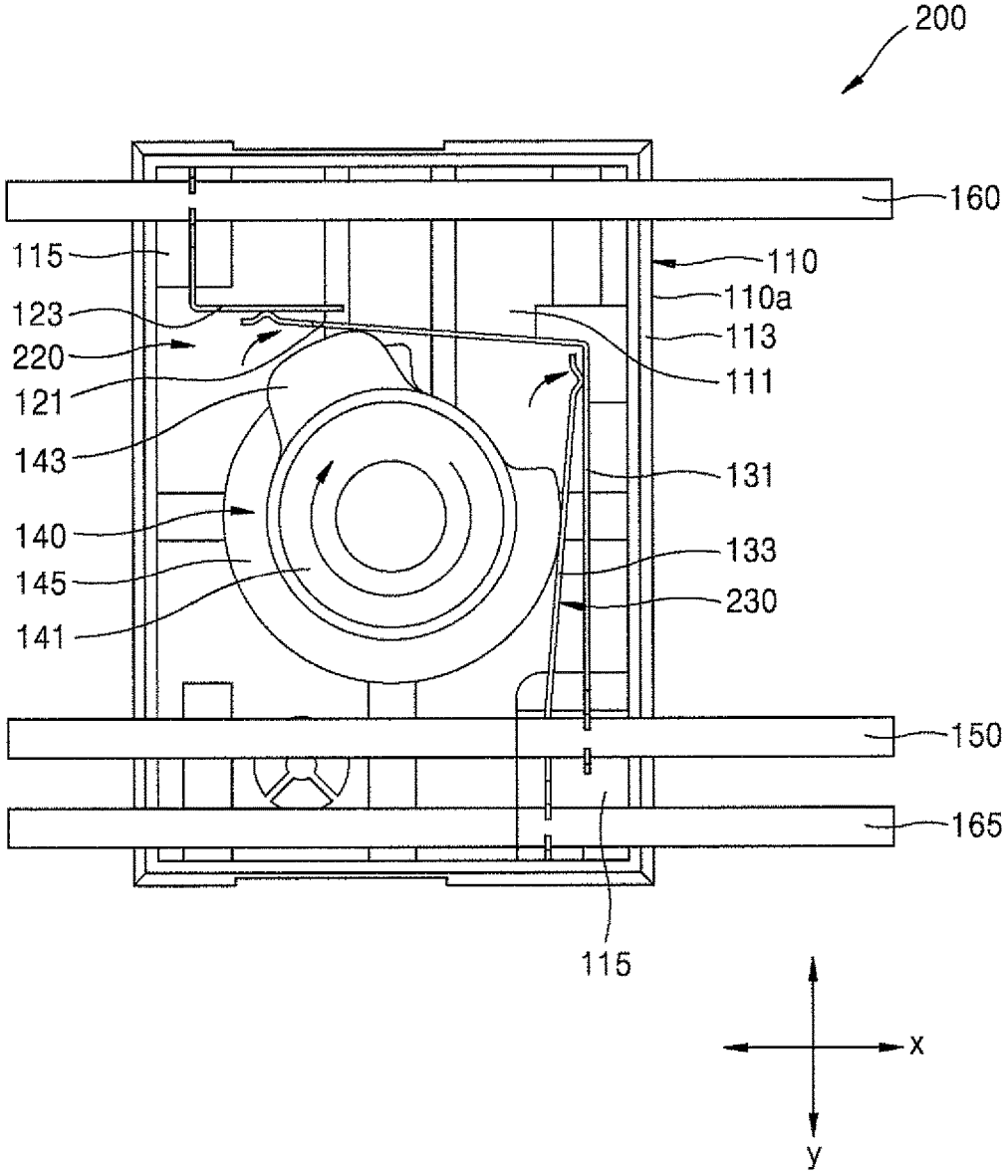
FIG. 12 shows operating states of a first switch and a second switch of the switch device as shown in FIG. 10.
Figure 13:
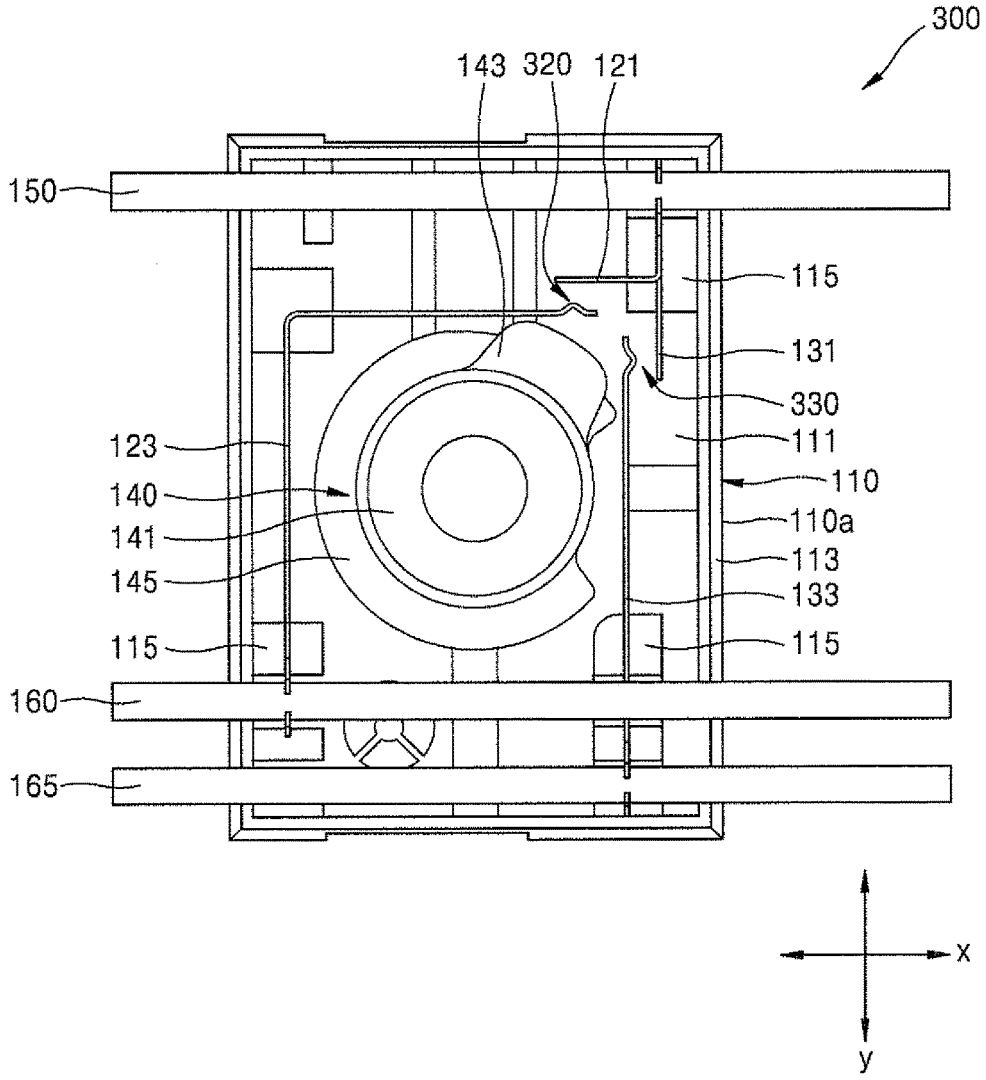
FIG. 13 is a perspective view showing an internal structure of a switch device according to another embodiment.
Figure 14:
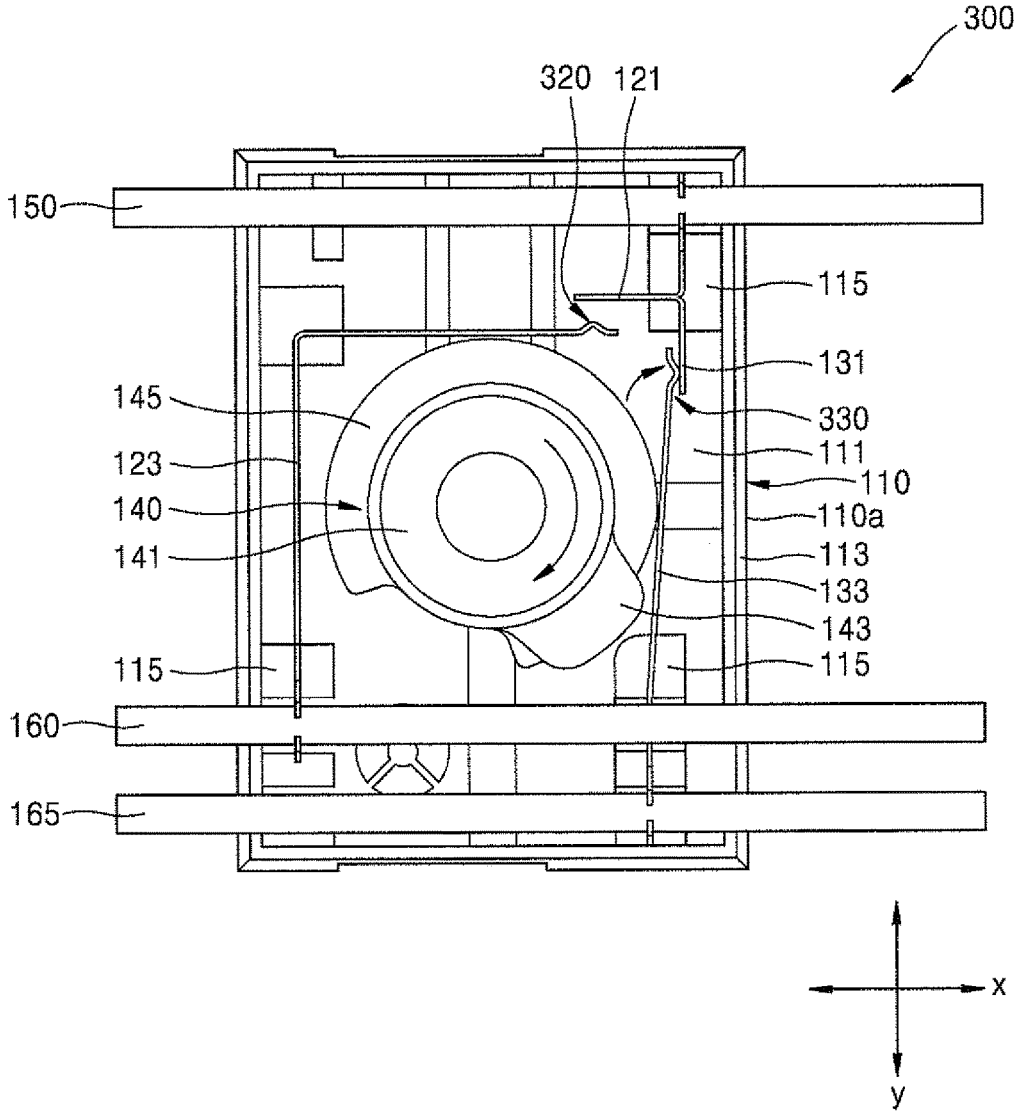
FIG. 14 shows an operating state of a second switch of the switch device as shown in FIG. 13.
Figure 15:
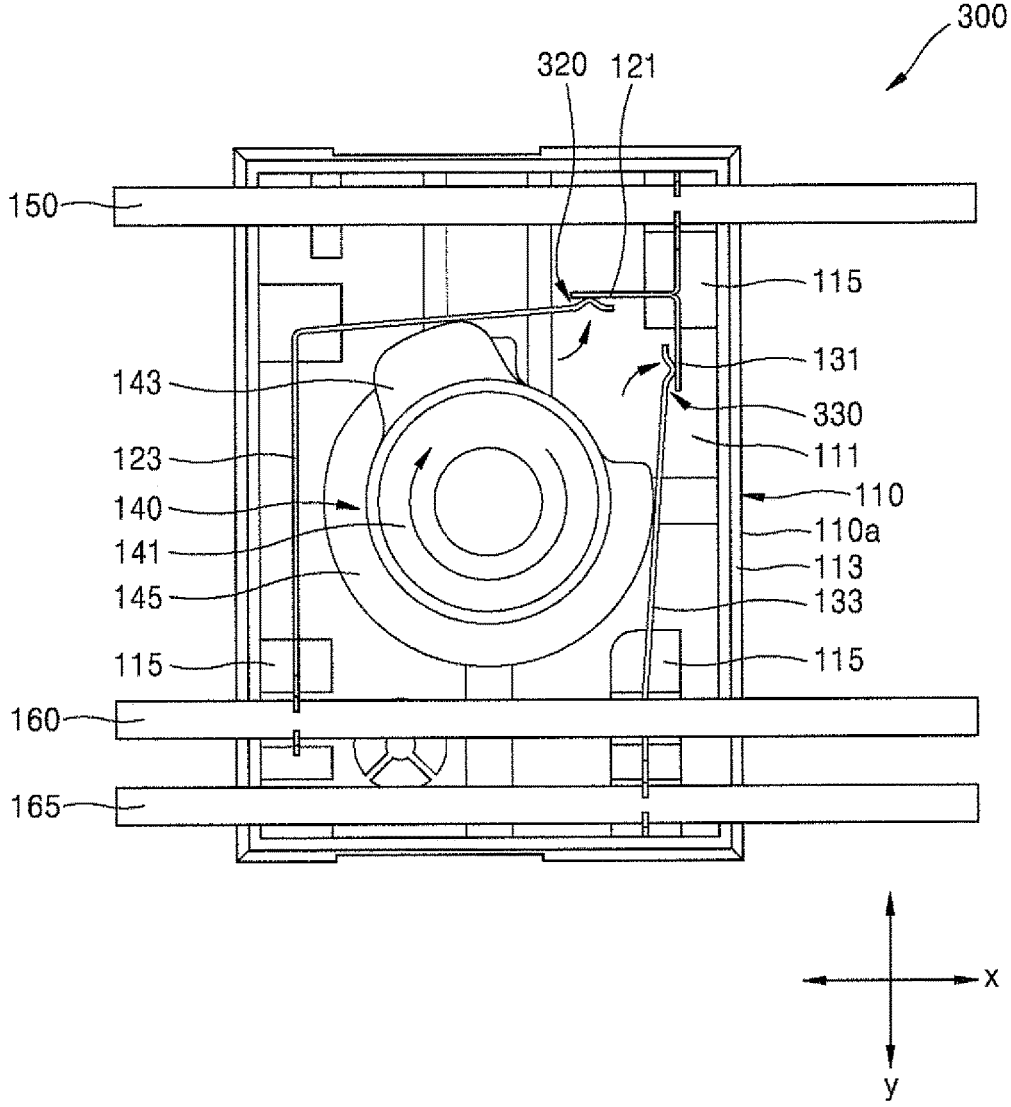
FIG. 15 shows operating states of a first switch and a second switch of the switch device as shown in FIG. 13.
Figure 16:
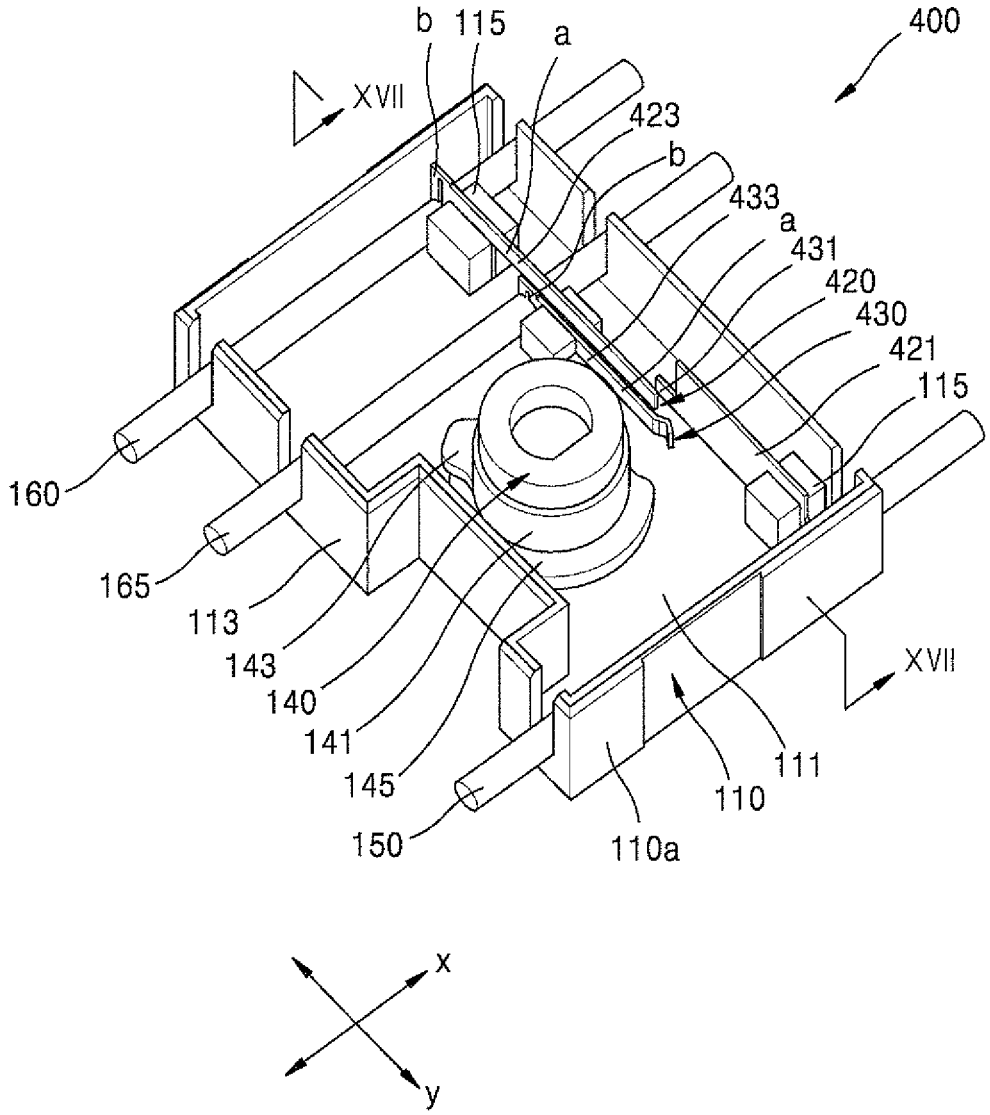
FIG. 16 is a perspective view showing an internal structure of a switch device according to another embodiment.
Figure 17:
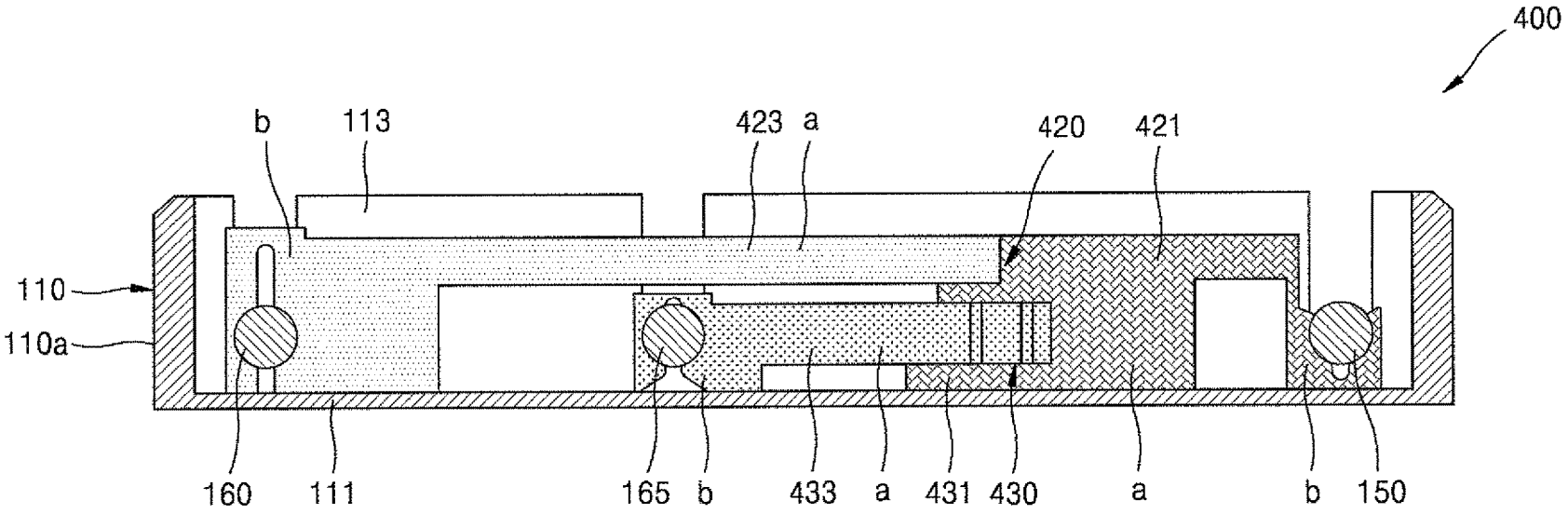
FIG. 17 is a cross-sectional view, taken along line XVII-XVII of FIG. 16.

FIG. 10 is a perspective view showing an internal structure of a switch device according to another embodiment. FIG. 11 shows an operating state of a second switch of the switch device as shown in FIG. 10. FIG. 12 shows operating states of a first switch and a second switch of the switch device as shown in FIG. 10. FIG. 13 is a perspective view showing an internal structure of a switch device according to an embodiment. FIG. 14 shows an operating state of a second switch of the switch device as shown in FIG. 13. FIG. 15 shows operating states of a first switch and a second switch of the switch device as shown in FIG. 13. FIG. 16 is a perspective view showing an internal structure of a switch device according to embodiment. FIG. 17 is a cross-sectional view, taken along line XVII-XVII of FIG. 16.

Hereinafter, various embodiments will be described with reference to FIG. 10 to FIG. 17. With this configuration, the same reference numerals used in the drawings described above with reference to the previous embodiment may refer to the same components having the same functions in the following embodiments. Therefore, redundant description of the same components has been omitted.

Referring to FIGS. 10 to 12, according to this embodiment, switch device 200 has a configuration in that the switch device 200 is connected to three conductors rather than four conductors. That is, the switch device 200 of this embodiment is connected to three conductors. Thus, in this configuration, the number of the conductors is reduced by one compared to that illustrated in the previous embodiment.

According to this embodiment, the actuator 140 is installed in the central region of the bottom face 111 having the central hole 112 defined therein. Further, around the central region of the bottom face 111 where the actuator 140 is installed, a single conductor 160 is disposed at one or a first side in the first direction Y, while a pair of conductors 150 and 165 is placed at the other or a second side in the first direction Y.

In this embodiment, around the central region of the bottom face 111 where the actuator 140 is installed, the first conductor 160 is disposed at the first side in the first direction Y, while the common conductor 150 and the second conductor 165 are disposed at the second side in the first direction Y. Thus, the number of the common conductor coupled to the switch device 200 in this embodiment is one. That is, the switch device 200 is connected to the single common conductor 150.

As with the first switch 120 (see FIG. 5) and the second switch 130 (see FIG. 5) illustrated in the previous embodiment, first switch 220 may include the first blade 121 and the second blade 123, and second switch 230 may include the third blade 131 and the fourth blade 133.

The first switch 220 and the second switch 230 illustrated in this embodiment differ from the first switch 120 and the second switch 130 illustrated in the previous embodiment as follows: the first blade 121 constituting the first switch 220 and the third blade 131 constituting the second switch 230 are integrally formed in this embodiment. That is, in the switch device 200 of this embodiment, the first blade 121 and the third blade 131 which are connected to the common conductor 150 are integrally formed to define an integration of the first blade 121 and the third blade 131. The integration of the first blade 121 and the third blade 131 may be installed to be connected to the single common conductor 150 inside the housing 110.

In one example, when viewed from the open top of the first housing 110*a* toward the bottom face 111 of the first housing 110*a*the integration of the first blade 121 and the third blade 131 may be configured to have an inverted-L shape. With this configuration, the first blade 121 may extend in a direction parallel to the second direction X, while the third blade 131 may extend in a direction parallel to the first direction Y.

In the integration of the first blade 121 and the third blade 131, the conductor-receiving portion b may be included only in one of the first blade 121 or the third blade 131. That is, when only one of the first blade 121 or the third blade 131 may be connected to the common conductor 150, both the first blade 121 and the third blade 131 may be electrically connected to the common conductor 150.

For example, when electrical connection is established between the common conductor 150 and the third blade 131 through coupling between the conductor-receiving portion b included in the third blade 131 and the common conductor 150, the first blade 121 may be electrically and indirectly coupled to the common conductor 150 via the third blade 131 without being directly coupled to the common conductor 150. In addition, in this embodiment, an example in which the first blade 121 is positioned closer to the actuator 140 than the second blade 123, and the third blade 131 is disposed at a position relatively farther from the actuator 140 than the fourth blade 133 is exemplified.

In this manner, generally, at least one of the first blade 121 or the third blade 131 integrally connected is positioned so as not to be in direct contact with the actuator 140. For example, the first blade 121, which is positioned relatively closer to the actuator 140 than the second blade 123, is positioned to be in direct contact with the first protrusion 143 when the contact between the first protrusion 143 and the first switch 220 is made. However, the third blade 131, which is located relatively farther away from the actuator 140 than the fourth blade 133, is positioned so as not to be in direct contact with the second protrusion 145 when the contact between the second protrusion 145 and the second switch 230 is made.

If both the first blade 121 and the third blade 131 are positioned to be in direct contact with the actuator 140, concurrent operations of the first switch 220 and the second switch 230 is not properly achieved. For example, when both the first blade 121 and the third blade 131 are positioned to be in direct contact with the actuator 140, the switch device 200 may operate as follows: when contact is established between the third blade 131 and the actuator 140, the third blade 131 is pressed by the second protrusion 145. In response, a shape of the third blade 131 is deformed such that the third blade 131 is pushed toward the fourth blade 133.

When the shape of the third blade 131 is deformed, a position of the first blade 121 connected to the third blade 131 is changed. Thus, the first protrusion 143 fails to press the first blade 121 properly. Alternatively, even when the first protrusion 143 presses the first blade 121, contact between the first blade 121 and the second blade 123 is not properly achieved. Thus, the first switch 220 may not be closed properly.

In view of this, in this embodiment, at least one of the first blade 121 or the third blade 131 integrally connected is disposed in a position not in direct contact with the actuator 140. This may allow the concurrent operations of the first switch 220 and the second switch 230 to be enabled properly without being affected by a state in which the two blades 121 and 131 are connected integrally.

All the components constituting the switch device 200 as described above may be disposed in a single inner space within the single housing 110. More specifically, the actuator 140 may be rotatably installed in a central region of the housing 110. The first switch 220 and the second switch 230 may be disposed around the actuator 140. With this configuration, the first switch 220, the second switch 230, and the actuator 140 are all located in the single inner space.

In the switch device 200, the first conductor 160 may be connected to the first switch 220, the second conductor 165 may be connected to the second switch 230, and the common conductor 150 may be connected to both the first switch 220 and the second switch 230. The conductors 150, 160, and 165 may extend through the single sidewall 113 and be disposed within the single inner space. All of the conductors 150, 160, and 165 and the first switch 220 and the second switch 230 may be disposed in the single inner space. In the single inner space, the conductors 150, 160, and 165 may be connected to the corresponding blades 121, 123, 131, and 133.

The switch device 200 according to this embodiment may provide for a multi-switching function in which multiple circuits are switched by rotation of the single rotational shaft, that is, the single knob and the valve stem connected thereto. That is, this embodiment may effectively provide for the multi-switching function using only one switch device instead of a plurality of switch devices.

Further, in the switch device 200 according to this embodiment, the plurality of switches 220 and 230 may be disposed in the single inner space defined in the single housing 110. Thus, a vertical stack of the switches 220 and 230 in order to realize the multi-switching function may not be required.

When the switches 220 and 230 are stacked in the vertical direction, respective structures for supporting the stacked switches 220 and 230 respectively need to be added. Therefore, a number of partitioning structures for dividing the internal space of the housing 110 in the vertical direction, corresponding to the number of the switches 220 and 230 should be added in the housing 110.

When the partitioning structures for partitioning the inner space of the housing 110 are added to the housing 110, an internal structure of the switch device 200 becomes complicated correspondingly. Further, a volume of the switch device 200 must be increased by a thickness occupied by the partitioning structures and a dimension of the vertical stack of the switches 220 and 230.

However, in the switch device 200 according to this embodiment, the plurality of switches 220 and 230 may be disposed within the single inner space of the single housing 110. Therefore, the switches 220 and 230 need not be stacked in the vertical direction in order to implement the multi-switching function. Accordingly, there is no need for the partitioning structures that divide the inner space of the housing 110 in the vertical direction, which may lead to a simple structure of the device.

That is, the switch device 200 according to this embodiment may be designed to have a simple structure without the partitioning structures for dividing the inner space of the housing 110 in the vertical direction. As a result, the switch device 200 according to this embodiment may have a compact structure, and may provide for a low manufacturing cost.

Further, in the switch device 200 of this embodiment, the plurality of switches 220 and 230 may be disposed in the single inner space within the single housing 110. With this configuration, only the single common conductor 150 may be used to implement the multiple switches 220 and 230. If the switches 220 and 230 are stacked in the vertical direction to implement the multi-switching function, a pair of conductors connected to each of the switches 220 and 230 which are positioned in the layers respectively is required. Thus, even though both one of a first pair of the conductors coupled to the first switch 220 in the first layer and one of a second pair of the conductors coupled to the second switch 220 in the second layer act as common conductors connected to the same potential, the first pair of conductors is required in the first layer and the second pair of conductors is required in the second layer.

However, in the switch device 200 of this embodiment, a plurality of switches 220 and 230 disposed in the single inner space of the single housing 110 may share the single common conductor 150. Thus, the single common conductor 150 alone may implement all of the plurality of switches 220, 230.

With this configuration, the switch device 200 of this embodiment may reduce the number of conductors required to realize the switch device 200. This allows the switch device 200 to be manufactured at a low manufacturing cost while having a more compact structure. Further, there is an advantage that wirings in the cooking appliance in which the switch device 200 is installed may be more simply configured.

Referring to FIGS. 13 to 15, according to this embodiment, switch device 300 may be connected to three conductors like the switch device 200 (see FIG. 10) as illustrated in the previous embodiment. In this embodiment, around the central region of the bottom face 111 where the actuator 140 is installed, common conductor 150 may be disposed at one or a first side in the first direction Y, while at the other or a second side in the first direction Y, the first conductor 160 and the second conductor 165 may be disposed.

Further, the first switch 320 may include a first blade 121 and a second blade 123. The second switch 330 may include a third blade 131 and a fourth blade 133.

With this configuration, the first blade 121 and the third blade 131 connected to the conductor 150 may be integrally connected to form an integration of the first blade 121 and the third blade 131. When viewed from the open top of the first housing 110*a* toward the bottom face 111 of the first housing 110*a*the integration of the first blade 121 and the third blade 131 has a clockwise-90 degree rotated T shape.

The second blade 123 may be connected to the first conductor 160. The fourth blade 133 may be connected to the second conductor 165. With this configuration, the first blade 121 and the second blade 123 may face each other in the first direction Y, while the third blade 131 and the fourth blade 133 may face each other in the second direction X.

The third blade 131 and the first blade 121 may be arranged at different positions from the bottom surface 111 of the first housing 110*a*that is, at different vertical levels. In one example, the third blade 131 is disposed at a higher level than the first blade 121.

Further, the first blade 121 may be positioned at a vertical level corresponding to the vertical level of the second blade 123, while the third blade 131 may be disposed at a vertical level corresponding to the vertical level of the fourth blade 133. The integration of the first blade 121 and the third blade 131 has a single conductor-receiving portion b coupled to the common conductor 150. A blade body a of the integration of the first blade 121 and the third blade 131 is branched into two branches.

With this configuration, the blade body a may branch in two mutually perpendicular directions to define the first blade 121 and the third blade 131, respectively. For example, a first branch extending in a direction parallel to the first direction Y may define the third blade 131, while a second branch extending in a direction parallel to the second direction X may define the first blade 121. The first and second branches may be formed at different vertical levels.

That is, the blade body a may be cut to be divided into an upper level portion and a lower level portion, and then, the upper level portion and the lower level portion may be bent at right angles relative to each other. This allows the integration of the first blade 121 and the third blade 131 to be formed such that contact between the first blade 121 and the second blade 123 and contact between the third blade 131 and the fourth blade 133 may occur at different vertical levels.

The second blade 123 may be formed as an inversed-L shape. The second blade 123 may be connected to the first conductor 160 at the second side in the first direction Y. The second blade 123 may be configured to be contactable with the first blade 121 disposed at the first side in the first direction Y. This may be realized via the inversed-L shape thereof.

Further, the fourth blade 133 may be connected to the second conductor 165 at the second side of the first direction Y. The fourth blade 133 may be configured to be contactable with the third blade 131 disposed at the first side in the first direction Y. That is, the fourth blade 133 may have a straight shape extending in the first direction Y.

Referring to the arrangement of the blades 121, 123, 131, and 133 that constitute the first switch 320 and the second switch 330, the integration of the first blade 121 and the third blade 131 may be located relatively farther from the actuator 140 than the second blade 123 and the fourth blade 133, which are separately formed. That is, the integration of the first blade 121 and the third blade 131 may be positioned as follows: when contact between the first protrusion 143 and the first switch 320 is made, the integration of the first blade 121 and the third blade 131 is not in direct contact with the first protrusion 143; and when contact between the second protrusion 145 and the second switch 330 is made, the integration of the first blade 121 and the third blade 131 is not in direct contact with the second protrusion 145.

In this way, pressurization from the actuator 140 is not applied directly to the integration of the first blade 121 and the third blade 131 in order that the first switch 320 is closed and the second switch 330 is closed. Thus, concurrent operations of the first switch 320 and the second switch 330 may be effected without being affected by the state that the two blades 121 and 131 are formed as a single body.

As shown in FIG. 16 and FIG. 17, a switch device 400, according to another embodiment, may be connected to three conductors as in the switch device 300 (see FIG. 15) illustrated in the previous embodiment. According to this embodiment, the actuator 140 may be installed in the central region of the bottom face 111 where the central hole 112 is defined. Further, around the central region of the bottom face 111 where the actuator 140 is installed, first conductor 160 and second conductor 165 may be disposed at one or a first side in the first direction Y, while a single common conductor 150 may be disposed at the other or a second side in the first direction Y.

With this configuration, the first conductor 160 may be disposed a relatively farther distance from the actuator 140 and the common conductor 150 than the second conductor 165. The common conductor 150, the first conductor 160, and the second conductor 165 may be disposed at a same distance from the bottom face 111 of the first housing 110*a*That is, the common conductor 150, the first conductor 160, and the second conductor 165 may be arranged at a same vertical level.

The configuration in which the conductors 150, and 160 and 165 are arranged at the same vertical level may reduce the vertical dimension of the housing 110 as required for the installation of the conductors as compared with the configuration where the conductors are arranged at different vertical levels. This may allow a more compact switch device 400 to be realized.

In order for all the conductors 150, and 160 and 165 to be placed at the same vertical level, it is required to modify an arrangement structure of blades 421, 423, 431, and 433 connected to the above-described conductors. Hereinafter, the arrangement structure of the blades 421, 423, 431, and 433 will be described.

According to this embodiment, the switch device 400 may include first switch 420 and second switch 430. The first switch 420 may include first blade 421 and second blade 423. The second switch 430 may include third blade 431 and fourth blade 433.

The first blade 421 may be connected to the common conductor 150 disposed at the second side of the first direction Y of the housing 110. The first blade 421 may have a straight shape extending along the first direction Y.

The second blade 423 may be connected to the first conductor 160 disposed at the first side in the first direction Y of the housing 110. The second blade 423 may have a straight shape extending along the first direction Y.

The third blade 431 may be connected to the common conductor 150 together with the first blade 421. The third blade 431 may have a straight shape extending along the first direction Y.

According to this embodiment, the first blade 421, which is a component of the first switch 420, and the third blade 431, which is a component of the second switch 430 may be integrally connected to form the integration of the first blade 421 and the third blade 431. That is, in the switch device 400 in this embodiment, the first blade 421 and the third blade 431, which are components connected to the common conductor 150 may be integrally connected. The integration of the first blade 421 and the third blade 431 may be installed to be connected to the single common conductor 150 inside the housing 110.

The integration of the first blade 431 and the third blade 433 may be connected to the common conductor 150 disposed at the second side in the first direction Y of the housing 110. The integration of the first blade 431 and the third blade 433 may have a linear shape extending along the first direction Y. The integration of the first blade 431 and the third blade 433 may have a length configured to allow contact thereof with both the second blade 423 and the fourth blade 433. The integration of the first blade 431 and the third blade 433 may have a construction to allow contact thereof with both the second blade 423 and the fourth blade 433, which are located at different vertical levels.

In one example, from a side elevation view of the housing 110, the integration of the first blade 421 and the third blade 431 has a "凸" Both the first blade 421 and the third blade 431 extend in a direction parallel to the first direction Y. The integration of the first blade 421 and the third blade 431 may be constructed such that the first blade 421 is disposed a greater distance from the bottom face 111 of the first housing 110*a* than the third blade 431, that is, the first blade 421 may be positioned at a higher level than the third blade 431.

In the integration of the first blade 421 and third blade 431, only one of the first blade 421 or the third blade 431 may have a conductor-receiving portion b. That is, when only one of the first blade 421 or the third blade 431 is connected to the common conductor 150, both the first blade 421 and the third blade 431 may be electrically connected to the common conductor 150.

For example, when an electrical connection is established between the common conductor 150 and the third blade 431 via the coupling between the conductor-receiving portion b included in the third blade 431 and the common conductor 150, the first blade 421 may be electrically coupled to the common conductor 150 via the third blade 431 without being directly coupled to the common conductor 150. That is, the integration of the first blade 421 and the third blade 431 shares the single conductor-receiving portion b. The electrical connection between the two blades 421 and 431 and the common conductor 150 may be completed at once by merely connecting the single conductor-receiving portion b to the common conductor 150.

The fourth blade 433 may be connected to the second conductor 165 disposed at the first side in the first direction Y of the housing 110. The fourth blade 433 may have a straight shape extending along the first direction Y.

In this embodiment, the first conductor 160 may be disposed at a position relatively far from the actuator 140 than the second conductor 165. Therefore, the second blade 431 may have a greater horizontal length than the fourth blade 421.

The main difference between the second blade 423 and the fourth blade 433 is that while the fourth blade 433 has a generally linear shape, the second blade 423 has a generally inversed-L shape, when viewed toward a side face of the housing 110. According to this embodiment, as the first conductor 160 is disposed at a position relatively farther from the actuator 140 than the second conductor 165, the second blade 423 to be connected to the first conductor 160 needs to have an interference-avoiding structure to avoid interference with the second conductor 165 passing through the extension path of the second blade to the first conductor 160.

With this in mind, the second blade 423 of this embodiment has the following construction. The receiving portion b of the second blade 423, coupled with the support structure of the first conductor 160 and the housing 110 may be formed at a vertical level higher than the vertical level of the second conductor 165. Further, the blade body a extending from the conductor-receiving portion b may be spaced from the bottom face 111 of the first housing 110*a* and may be formed at a level higher than the vertical level of the second conductor 165. That is, the blade body a extending from the conductor-receiving portion b may extend at a level higher than the second conductor 165.

That is, the conductor-receiving portion b and the blade body a of the second blade 423 together may define the inversed-L shape when viewed from the side face of the housing 110. The second conductor 165 may pass through below the blade body a of the second blade 423. Thus, all of the blades 421, 431, 431, and 433 may be space-efficiently positioned within the single inner space within the housing 110 to realize the switch device 400.

Referring to the array structure of the blades 421, 423, 431, and 433 constituting the first switch 420 and the second switch 430, the integration of the first blade 421 and third blade 433 is positioned at a farthest position from the actuator 140, while the second blade 423 and the fourth blade 433 are positioned between the integration of the first blade 421 and the third blade 433 and the actuator 140. The blades 421, 423, 431 and 433 positioned in this manner are arranged at a predetermined spacing from each other in the second direction X.

In this embodiment, all of the first blade 421, the second blade 421, the third blade 431, and the fourth blade 433 may be positioned in one of two sub-regions partitioned in the second direction X about the actuator 140. For example, the integration of the first blade 421 and the third blade 431 may be positioned adjacent to one of two parallel longitudinal side walls constituting the sidewall 113, where the one is disposed at the second side in the second direction X of the housing. Further, the second blade 423 and the fourth blade 433 may be positioned adjacent to the one of two parallel longitudinal side walls. The integration of the first blade 421 and the third blade 431 may be located at the first side in the Y direction about the actuator 140, while the second blade 423 and the fourth blade 433 may be located at the second side in the Y direction about the actuator 140. A virtual extension of the second blade 423 and the fourth blade 433 may be positioned between the integration of the first blade 421 and the third blade 431 and the actuator 140.

Thus, when all of the blades 421, 423, 431, and 433 are positioned in one of two sub-regions partitioned in the second direction X about the actuator 140, a size of the housing 110 may be reduced by a size of the other of the two sub-regions partitioned in the second direction X about the actuator 140, that is, the size of the sub-region in which the blades 421, 423, 431, and 433 are not installed.

Accordingly, the switch device 400 of this embodiment may be manufactured with a more compact size due to the reduced size of the housing 110, which may contribute to downsizing of the cooking appliance in which the switch device 400 is installed. Further, this may provide for a higher degree of design freedom for the appliance in which the switch device 400 is installed.

Figure 18:
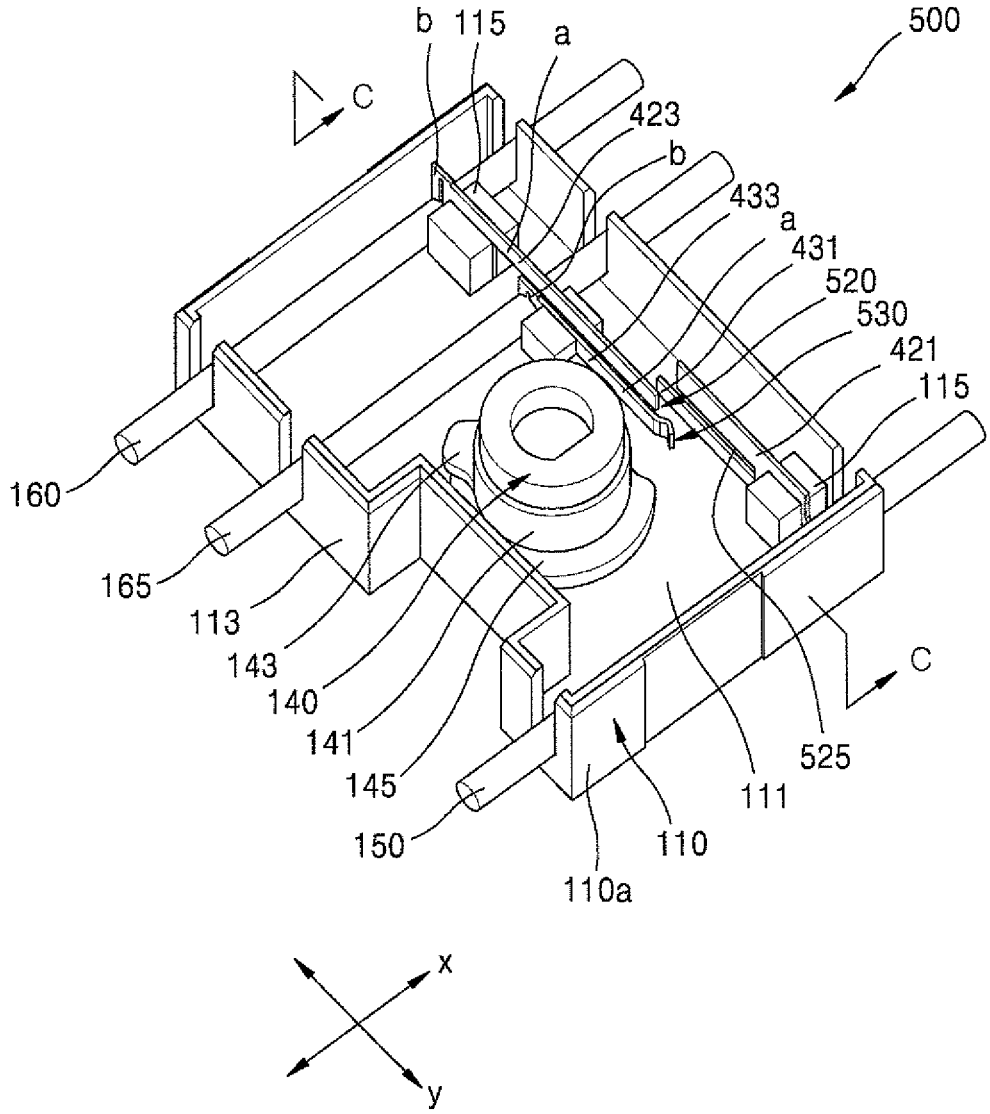
FIG. 18 is a perspective view showing an internal structure of a switch device according to another embodiment.
Figure 19:
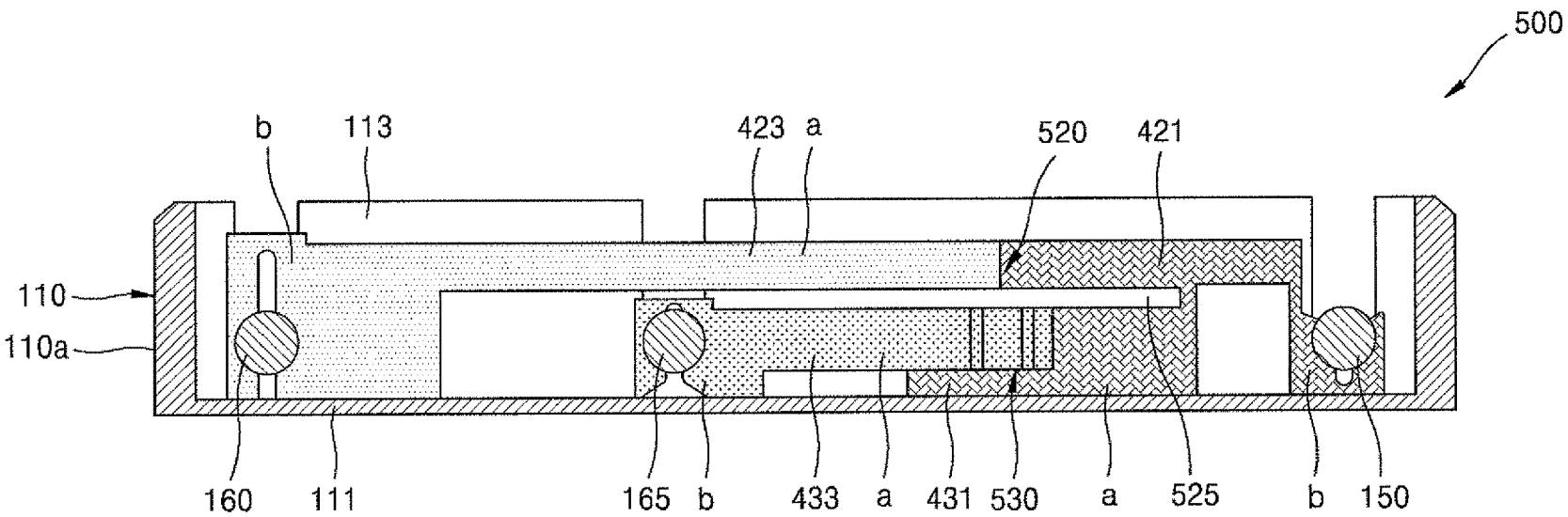
FIG. 19 is a cross-sectional view, taken along line XIX-XIX of FIG. 18.

FIG. 18 is a perspective view showing an internal structure of a switch device according to another embodiment. FIG. 19 is a cross-sectional view, taken along line XIX-XIX of FIG. 18.

Referring FIG. 18 and FIG. 19, the switch device 500 according to this embodiment has a configuration similar to the switch device 400 (see FIG. 17) illustrated in the previous embodiment. The first blade 421, which is a component of first switch 520, and the third blade 431, which is a component of second switch 530 are integrally connected to form an integration of the first blade 421 and the third blade 431.

In this embodiment, from a side elevation view of the housing 110, the integration of the first blade 421 and the third blade 431 has a "凸" shape.

In the integration of the first blade 421 and third blade 431, only one of the first blade 421 or the third blade 431 may have a conductor-receiving portion b. That is, when only one of the first blade 421 or the third blade 431 is connected to the common conductor 150, both the first blade 421 and the third blade 431 may be electrically connected to the common conductor 150.

For example, when an electrical connection is established between the common conductor 150 and the third blade 431 via the coupling between the conductor-receiving portion b included in the third blade 431 and the common conductor 150, the first blade 421 may be electrically coupled to the common conductor 150 via the third blade 431 without being directly coupled to the common conductor 150. That is, the integration of the first blade 421 and the third blade 431 shares the single conductor-receiving portion b. The electrical connection between the two blades 421 and 431 and the common conductor 150 may be completed at once by merely connecting the single conductor-receiving portion b to the common conductor 150.

The difference between the switch device 500 according to this embodiment and the switch device 400 illustrated in the previous embodiment is as follows: a cut-out 525 is defined within the integration of the first blade 421 constituting a portion of the first switch 520 and the third blade 431 constituting a portion of the second switch 530. According to this embodiment, at a first side in the first direction Y of the housing 110, the second blade 423 is positioned vertically farther from the bottom face 111 of the first housing 110*a* than the fourth blade 433. Further, at a second side in the first direction Y of the housing 110, the first blade 421 is positioned vertically farther from the bottom face 111 of the first housing 110*a* than the third blade 431. This ensures that contact between the first blade 421 and the second blade 423 occurs at a higher level than contact between the third blade 431 and the fourth blade 431 In other words, contact between the third blade 431 and the fourth blade 433 may be made at a position vertically closer to the bottom face 111 of the first housing 110*a* than the contact between the first blade 421 and the second blade 423.

Further, the integration of the first blade 421 and the third blade 431 may have the cut-out 525 defined therein that partially separates the first blade 421 and the third blade 431 from each other. The cut-out 525 may be defined by cutting an elongate portion or slot between the first blade 421 and the third blade 431 which are in contact with each other. Thus, the integration of the first blade 421 and the third blade 431 may have a configuration in which a portion of the first blade 421 and a portion of the third blade 431 may be bent independently of each other.

In this embodiment, in the integration of the first blade 421 and third blade 431, the first blade 421 may define an upper integration, while the third blade 431 may define a lower integration. The cut-out 525 may be defined between the first blade 421 and the third blade 431. A shape of the cut-out 525 may have one open lateral side.

The construction of the integration of the first blade 421 and the third blade 431 may be provided such that when contact between the first blade 421 and the second blade 423 and contact between the third blade 431 and the fourth blade 433 occur simultaneously, the contacts at both contact points may be executed in a stable manner. That is, when the integration of the first blade 421 and the third blade 431 is established to have the cut-out 525 as described above, this may have the following effect: when the first blade 421 and the second blade 423 contact each other, a force exerted by the second blade 423 toward the first blade 421 may push the first blade 421 outwardly. Only a bent deformation of the first blade 421 is generated, and a pressing force is not transmitted to the third blade 431.

Conversely, when contact is made between the third blade 431 and the fourth blade 433, the third blade 431 is pushed outwardly by a force applied by the fourth blade 433. Only a bent deformation of the third blade 431 is generated and a pressing force is not transmitted to the first blade 421.

That is, the cut-out 525 defined between the first blade 421 and the third blade 431 may allow the first blade 421 and the third blade 431 to be independently bent. As a result, concurrent operation of the first switch 520 and the second switch 530 may be effectively conducted without being affected by a state in which the two blades 421 and 431 form the integration of the first blade 421 and the third blade 431.

The switch device 500 of this embodiment as described above may provide at least the following advantages.

First, in the switch device 500 of this embodiment, the plurality of switches 520 and 530 may be disposed in the single inner space within the single housing 110. With this configuration, only the single common conductor 150 may be used to implement the multiple switches 520 and 530.

If the switches 520 and 530 are stacked in the vertical direction to implement the multi-switching function, a pair of conductors connected to each of the switches 520 and 530 which are positioned in the layers respectively is required. Thus, even though both of one of a first pair of the conductors coupled to the first switch 520 in the first layer and one of a second pair of the conductors coupled to the second switch 520 in the second layer act as common conductors connected to the same potential, the first pair of conductors is required in the first layer and the second pair of conductors is required in the second layer.

However, in the switch device 500 of this embodiment, a plurality of switches 520 and 530 disposed in the single inner space of the single housing 110 may share the single common conductor 150. Thus, the single common conductor 150 alone may implement all of the plurality of switches 520, 530.

With this configuration, the switch device 500 of this embodiment may reduce the number of conductors required to realize the switch device 500. For example, the number of conductors may be reduced from 4 to 3. This allows the switch device to be manufactured at a low manufacturing cost while having a more compact structure. Further, there is an advantage in that wirings in the cooking appliance in which the switch device 500 is installed may be more simply configured.

Second, the switch device 500 of this embodiment has a configuration in which the integration of the first blade 421 and the third blade 431 share the single conductor-receiving portion b. Thus, the electrical connection between the two blades 421 and 431 and the common conductor 150 may be completed at once by merely connecting the shared single conductor-receiving portion b to the common conductor 150.

if a switch device is configured in a structure in which the switches 520 and 530 are stacked in the vertical direction to implement a multi-switching function, a pair of conductors connected to each of the switches 520 and 530 which are positioned in the layers respectively is required. Thus, this may require fixedly inserting each of the blades to be connected to these conductors into the housing 110 and connecting the blades to the conductors should be conducted individually.

For example, if a switch device is configured with two switches stacked in the vertical direction, a step for installing a total of four conductors, four steps for fixedly inserting the four blades into the housing 110 respectively, and four steps for connecting the four blades to four conductors respectively should be conducted individually.

However, in this embodiment, the plurality of switches 520, and 530 positioned in the single inner space of the single housing 110 share the single common conductor 150. Further, the integration of the first blade 421 and the third blade 431 shares the single conductor-receiving portion b. Thus, the required manufacturing process steps of the switch device 500 may be reduced compared to the conventional case. That is, fabrication of the switch device 500 of this embodiment may require a step for installing a total of the three conductors 150, 160, and 165, three steps for fixedly inserting the blades 421, 423, 431, and 433 into the housing 110 respectively, and three steps for connecting the blades 421, 423, 431, and 433 to the three conductors 150, 160, and 165 respectively.

The above advantages may be achieved by the following characteristic configurations of the switch device 500 of this embodiment: the configuration in which the switch device 500 is connected to the three conductors 150, and 160 and 165, not to four conductors; the configuration in which the first blade 421 and the third blade 431 are integrally connected to form a single integration thereof; and the configuration in which the integration of the first blade 421 and the third blade 431 shares the single conductor-receiving portion b. As the number of manufacturing process steps is reduced, the process of fabricating the switch device 500 may be very effectively simplified. Further, this may lower a risk probability that the blades 421, 423, 431, and 433 will be removed, due to the reduced number of engaged portions with the blades 421, 423, 431, and 433, thereby reducing the risk of product failure.

Further, in the switch device 500 of this embodiment, electrical connection between the two blades 421 and 431 and the common conductor 150 may be completed at once by merely connecting the shared single conductor-receiving portion b to the common conductor 150. This may reduce the number of the coupling points between the conductors and the blades. Further, as the number of the coupling points between the conductors and the blades is reduced, the housing 110 may be reduced in size, so that the switch device 500 with a more compact structure may be provided.

Figure 20:
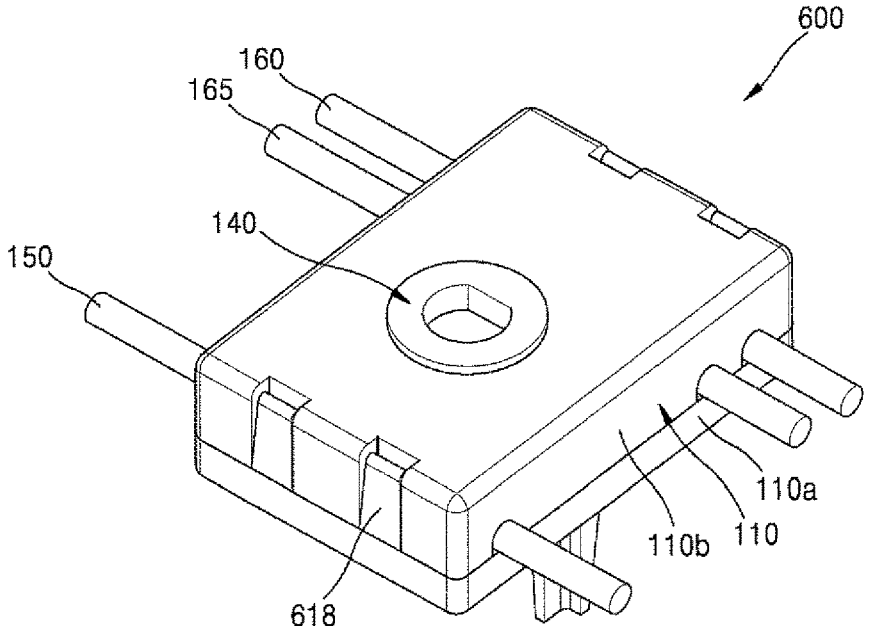
FIG. 20 is a perspective view of a switch device according to another embodiment.
Figure 21:
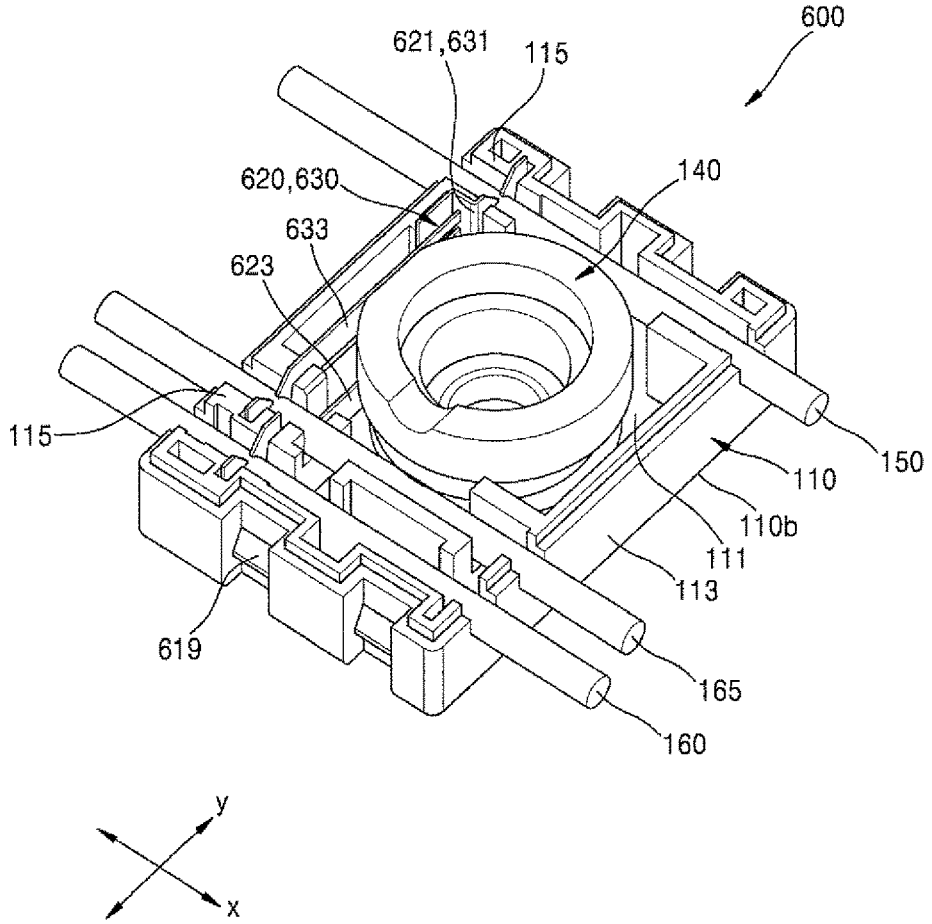
FIG. 21 is a bottom perspective view showing an internal structure of the switch device as shown in FIG. 20.
Figure 22:
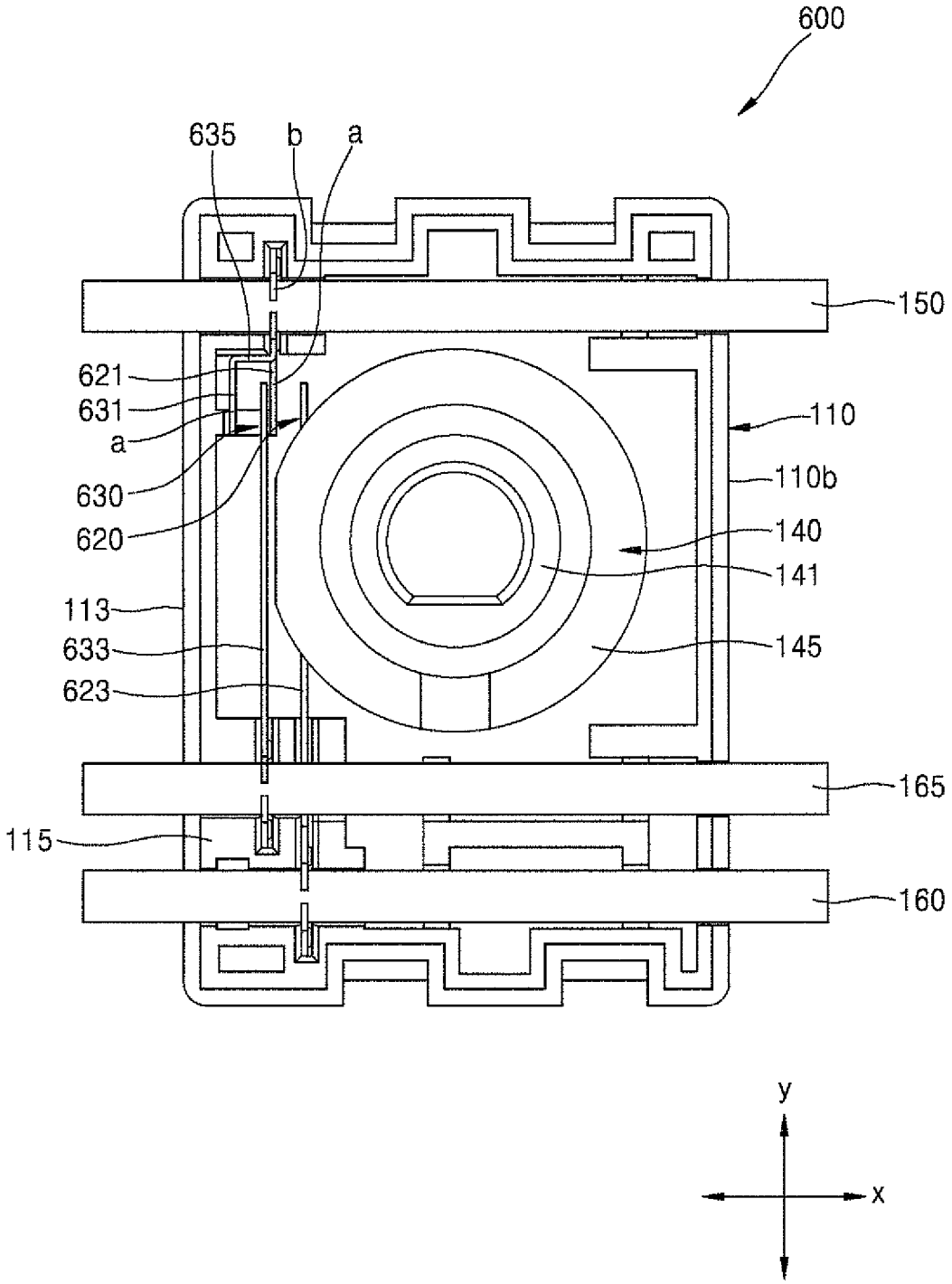
FIG. 22 is a bottom view showing the internal structure of the switch device as shown in FIG. 21.
Figure 23:
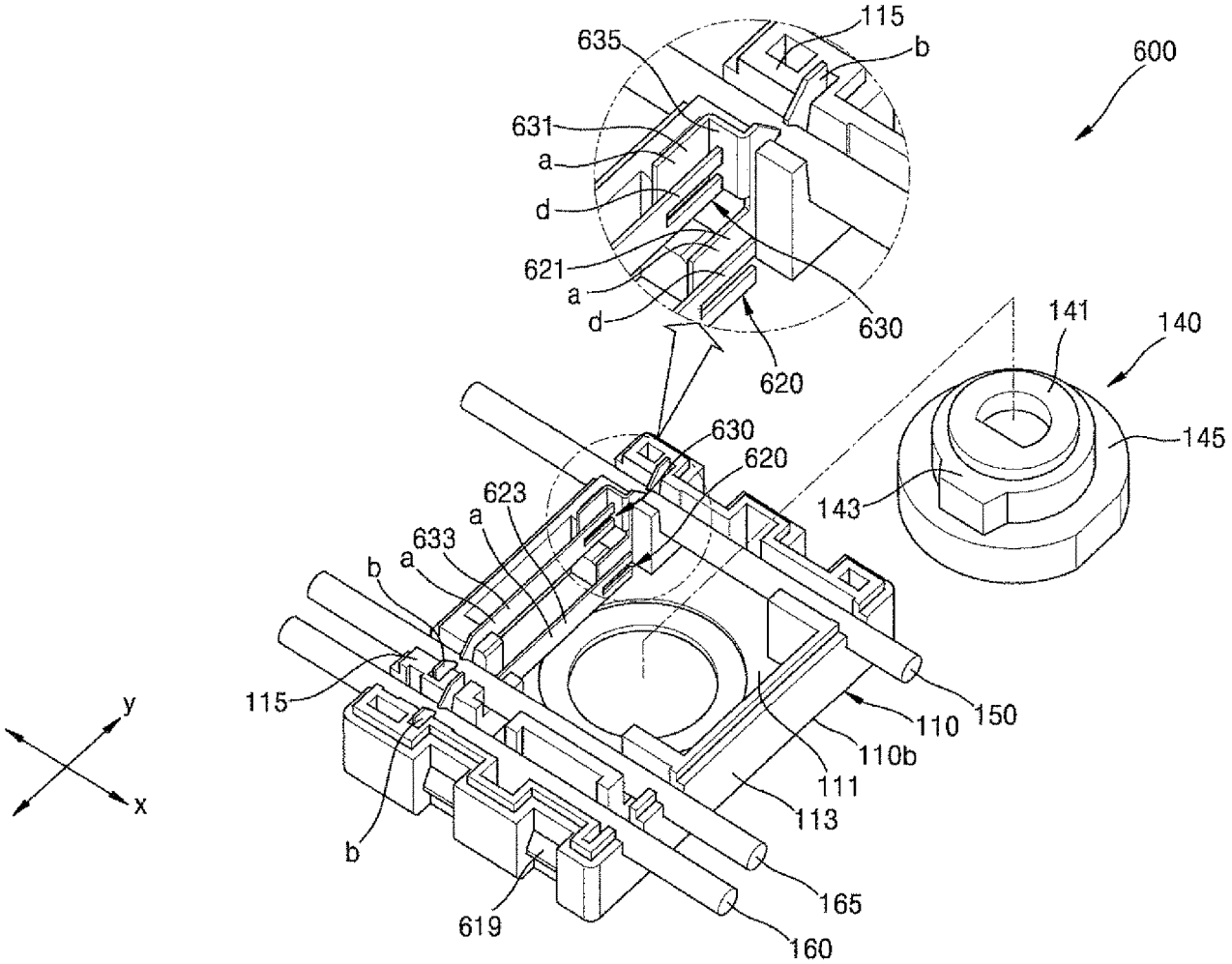
FIG. 23 is an exploded perspective view showing an actuator of the switch device as shown in FIG. 21.

FIG. 20 is a perspective view of a switch device according to another embodiment. FIG. 21 is a bottom perspective view showing an internal structure of the switch device as shown in FIG. 20. FIG. 22 is a bottom view showing internal structure of the switch device as shown in FIG. 21. FIG. 23 is an exploded perspective view of an actuator of the switch device as shown in FIG. 21.

Referring to FIGS. 20 to 23, the arrangement of switches 620 and 630 and the arrangement of blades 621, 623, 631, and 633 constituting the switches 620 and 630 in switch device 600 according to this embodiment may be substantially similar to the arrangement of the switches (420 and 430; see FIG. 18) and the arrangement of the blades (421, 423, 431 and 433; see FIG. 18) in the switch device 500 as illustrated in the previous embodiment. The main difference between the switch device 600 of this embodiment and the switch device 500 of the previous embodiment lies in a location of a support structure and a specific shape of each of the blade 621, 623, 631, and 633.

According to this embodiment, the housing 110 may include a combination of first housing 110*a* and second housing 110*b*, which are coupled in the vertical direction. Further, the first housing 110*a* and the second housing 110*b* may each include square-shaped bottom face 111 and sidewall 113 extending vertically from an outer edge of the bottom face 111 and surrounding the bottom face 111.

In one example, coupling between the first housing 110*a* and the second housing 110*b* may be accomplished by engagement between an engaging hook 618 and a stopper protrusion 619. More specifically, when the first housing 110*a* and the second housing 110*b* are brought into contact with each other in the vertical direction, the engaging hook 618 provided on the first housing 110*a* may be engaged with the stopper protrusion 619 provided on the second housing 110*b* so that coupling between the engaging hook 618 and the stopper protrusion 619 is performed. The coupling between the engaging hook 618 and the stopper protrusion 619 may lead to the coupling between the first housing 110*a* and the second housing 110*b*. That is, assembly of the housing 110 may be completed by merely engaging the first housing 110*a* and the second housing 110*b* with each other. Thus, manufacture of the switch device 600 may be made easier and quicker.

In one implementation of the switch device 600, the support structure is provided on the housing 110, more specifically, on the second housing 110*b*, which is the upper housing of the housing 110. That is, the support structure is provided on the second housing 110*b* rather than the first housing 110*a*, which is a lower housing. The support structure projects from the bottom face 111 of the second housing 110*b*. The support structure may have support blocks 115 and slots 116.

Further, the support structure may have conductor-receiving grooves 117 defined in the support blocks 115. The conductor-receiving grooves 117 may accommodate therein at least one of first conductor 160, second conductor 165, or common conductor 150 which extend through the housing 110.

Hereinafter, a configuration of each of first switch 620 and second switch 630 will be described.

According to this embodiment, the first switch 620 may include first blade 621 and second blade 623. The second switch 630 may include third blade 631 and fourth blade 633. The second blade 623 and the fourth blade 633 may each have a shape similar to each of the second blade 423 (see FIG. 18) and the fourth blade 433 (see FIG. 18) illustrated in the previous embodiment.

The second blade 623 and the fourth blade 633 illustrated in this embodiment differ from the second blade 423 and the fourth blade 433 illustrated in the previous embodiment in that the second blade 623 and the fourth blade 633 each have a contact portion d. The contact portion d may define a portion of a blade body a of each of the second blade 623 and the fourth blade 633. The contact portion d may define a contact portion of each blade body a with the first blade 621 and the third blade 631. That is, the contact portion d may define a longitudinal distal end of each blade body a.

More specifically, the contact portion d may be formed by cutting a longitudinal distal end of each blade body a of the second blade 623 and the fourth blade 633 to be branched into branched portions. In this embodiment, the contact portion d may be formed by cutting the longitudinal distal end of the blade body a to be branched into two branches. In this example, the contact portion d may be defined to have a bifurcated c shape of the end of the blade body a.

The contact portion d may define each of a contact portion between the second blade 623 and the first blade 621 and a contact portion between the fourth blade 633 and the third blade 631. When the second blade 623 and the fourth blade 633 each have the contact portion d, this exhibits the following effect. The second blade 623 and the fourth blade 633 are pressed by the actuator 140 so that contacts of the second blade 623 and the fourth blade 633 with the first blade 621 and the second blade 623 respectively occur. At this time, due to the contact portion d having the cut-out, the longitudinal distal end of each of the second blade 623 and fourth blade 633 may flex more flexibly while the blades 623 and 633 contact the first blade 621 and the third blade 631, respectively.

In this way, when the second blade 623 and the fourth blade 633 are in contact with the first blade 621 and the third blade 631, respectively, the longitudinal distal ends of the second blade 623 and fourth blade 633 may flex more flexibly. This may allow contact faces between the first blades 621 and the second blades 623 and contact faces between the third blades 631 and the fourth blades 633 to contact more tightly and reliably.

As a result, this may effectively solve the problem of poor contact, which may otherwise occur when the contact between the blades is not properly performed. This may allow implementation of the switch device 600 with further improved performance to be achieved.

In one implementation of the switch device, regarding the configuration of the integration of the first blade 621 and the third blade 631, both a blade body a defining a portion of the first blade 621 and a blade body a defining a portion of a third blade 631 may be connected to a single conductor-receiving portion b.

With this configuration, the blade body a defining a portion of the first blade 621 is positioned vertically closer to the bottom face 111 of the second housing 110*b* than the third blade 631. Further, the blade body a defining a portion of the third blade 631 is positioned vertically farther away from the bottom face 111 of the second housing 110*b* than the first blade 621.

According to this embodiment, the second blade 623 and the fourth blade 633 are arranged at a predetermined distance along the second direction x. Further, the blade body a defining a portion of the first blade 621 and the blade body a defining a portion of the third blade 631 are spaced apart by a distance corresponding to the spacing distance between the second blade 623 and the fourth blade 633. For the spacing between the blade body a defining a portion of the first blade 621 and the blade body a defining a portion of the third blade 631, the integration of the first blade 621 and the third blade 631 has a bent connector 635.

The bent connector 635 may be formed between the conductor-receiving portion b included in the integration of the first blade 621 and the third blade 631 and the blade body a of the third blade 631. Thus, the bent connector 635 connects, in a bent form, the conductor-receiving portion b included in the integration of the first blade 621 and the third blade 631 and the blade body a of the third blade 631.

In one example, when viewed from the open bottom of the second housing 110*b* towards the bottom face 111 of the second housing 110*b*, the bent connector 635 may connect, in a stepped shape, the conductor-receiving portion b included in the integration of the first blade 621 and the third blade 631 and the blade body a of the third blade 631. Further, regarding the integration of the first blade 621 and the third blade 631, when viewed from the open bottom of the second housing 110*b* toward the bottom face 111 of the second housing 110*b*, the conductor-receiving portion b, the blade body a of the first blade 621 and the blade body a of the third blade 631 may be connected via the bent connector d to form a connection shape ⊢.

The configuration of the integration of the first blade 621 and the third blade 631 as described above has the following advantage. When the contact between the first blade 621 and the second blade 623 and the contact between the third blade 631 and the fourth blade 633 occur at different positions along the second direction X, the opening and closing of the first switch 620 may not interfere with the opening and closing of the second switch 630. This may result in the provision of the switch device 600 with improved operational reliability.

Embodiments disclosed herein provide a switch device that may provide a multi-switching function while having a compact structure and being manufactured at a low manufacturing cost, and a cooking appliance including a switching device.

The purposes are not limited to the above-mentioned purposes. Other purposes and advantages, not mentioned above, may be understood from the above descriptions and more clearly understood from the embodiments. Further, it will be readily appreciated that objects and advantages may be realized by features and combinations thereof as disclosed in the claims.

Embodiments disclosed herein provide a switch device that may include a first switch including a first blade and a second blade configured to contact or non-contact each other, the first switch being configured to be opened or closed based on a contact or non-contact between the first blade and the second blade; a second switch including a third blade and a fourth blade configured to contact or non-contact each other, the second switch being configured to be opened and closed based on a contact or non-contact between the third blade and the fourth blade; a housing for accommodating the first switch and the second switch therein; and an actuator disposed in the housing and actuated to selectively open and close the first switch and the second switch. The first switch and the second switch may be fixedly supported by a support structure disposed on a same plane as a mounting plane for the actuator and positioned in a single inner space.

The actuator may include a first protrusion that presses the first switch in a contact region with the first switch such that the first blade and the second blade are in contact with each other; a second protrusion that presses the second switch in a contact region with the second switch such that the third blade and the fourth blade are in contact with each other; and a rotatable body rotatably mounted on a bottom face of said housing. The first protrusion and the second protrusion may each protrude horizontally outward from an outer circumferential surface of the rotatable body.

The first blade and the third blade may be connected to a common conductor passing through the housing. The second blade may be connected to a first conductor passing through the housing. The common conductor and the first conductor may pass through the single inner space within the housing. The fourth blade may be connected to a second conductor passing through the housing. The common conductor and the first conductor and the second conductor may pass through the single inner space in the housing.

The common conductor may include a first common conductor connected to the first blade and a second common conductor connected to the second blade. The first common conductor and the first conductor may be positioned at one or a first side of a first direction of the housing. The second common conductor and the second conductor may be positioned at the other or a second side of the first direction. The actuator may be positioned between one end and the other side of the first direction. The first blade and the second blade may be positioned at one or a first side of a second direction orthogonal to the first direction. The third blade and the fourth blade may be positioned at the other or a second side of the second direction. The actuator may be positioned between the one end and the other side of the second direction of the housing.

The first blade and the third blade may be integrally connected. The integration of the first blade and the third blade may be connected to a single common conductor.

The first conductor may be positioned at the one side of the first direction of the housing. The common conductor and the second conductor may be positioned at the other side of the first direction. The actuator may be positioned between the one end and the other side of the first direction. The third blade may be connected to the common conductor. The first blade may be connected to the third blade in an inverted-L shape. The first blade and the second blade may be positioned facing each other in the first direction. The third blade and the fourth blade may be positioned facing each other in the second direction.

The common conductor may be positioned at the one side of the first direction of the housing. The first conductor and the second conductor may be positioned at the other side of the first direction. The actuator may be positioned between the one end and the other side of the first direction. The third blade may be connected to the common conductor. The first blade may be connected to the third blade to form a clockwise 90 degrees rotated T shape. The first blade and the second blade may be positioned facing each other in the first direction. The third blade and the fourth blade may be positioned facing each other in the second direction.

The common conductor may be positioned at the one side of the first direction of the housing. The first conductor and the second conductor may be positioned at the other side of the first direction. The actuator may be positioned between one end and the other side of the first direction. The second conductor may be positioned a greater distance from the common conductor than the first conductor. The second blade may include a blade body having a length extending in the first direction and defining a contact face for contacting the first blade, and a conductor-receiving portion that receives the first conductor to allow coupling the blade body to the first conductor. The conductor-receiving portion and the blade body may be connected with each other to form an inverted-L shape so that the blade body may be positioned at a higher vertical level from the bottom face of the housing than that of the second conductor.

The second blade may be positioned at a higher vertical level from the bottom face of the housing than the fourth blade. The first blade may be positioned at a higher vertical level from the bottom face of the housing than the third blade. The integration of the first blade and the third blade may be constructed such that both a blade body defining a portion of the first blade and a blade body defining a portion of the third blade may be connected to the single conductor-receiving portion connected to the common conductor. A cut-out may be defined between the blade body defining a portion of the first blade and the blade body defining a portion of the third blade. The integration of the first blade and the third blade may be constructed such that the first blade defines an upper integration, the third blade defines a lower integration, and the cut-out is defined between the first blade and the third blade.

The second blade and the fourth blade may be arranged to be spaced apart by a predetermining spacing from each other in a second direction orthogonal to the first direction. The blade body defining a portion of the first blade and the blade body defining a portion of the third blade may be arranged to be spaced apart from each other by the spacing between the second blade and the fourth blade.

The integration of the first blade and the third blade may include a bent connector. The bent connector may separate the blade body defining a portion of the third blade from the blade body defining a portion of the first blade by a predetermined distance along the second direction. The bent connector may be connected to the conductor-receiving portion.

The blade body of the at least one of the second blade or the fourth blade may have a contact portion with the integration of the first blade and the third blade. The contact portion may be branched into a plurality of spaced and branched portions. The contact portion may be defined with a c shape at an end of the blade body.

All of the first blade, the second blade, the third blade, and the fourth blade may be positioned in one of both opposite ends of the second direction of the housing. The second direction may be orthogonal to the first direction. The actuator may be positioned between both opposite ends of the second direction of the housing.

The housing may include a bottom face on which the first switch, the second switch, and the actuator are installed, and a sidewall that surrounds the bottom face. The integration of the first blade and the third blade may be positioned adjacent to one of two parallel longitudinal side walls constituting the sidewall. The one may be disposed at the other side of the second direction. The second blade and the fourth blade may be positioned adjacent to one of two parallel longitudinal side walls. A virtual extension of the second blade and the fourth blade may be positioned between the integration of the first blade and the third blade and the actuator.

One of the first blade or the second blade, positioned closer to the actuator, may be positioned such that at least a portion thereof is present or located within a displacement range of the first protrusion. One of the third blade and the fourth blade, which is positioned closer to the actuator, may be positioned such that at least a portion thereof is present or located within a displacement range of the second protrusion.

One of the first blade or the second blade, positioned closer to the actuator, may be positioned farther from the bottom face of the housing than the third blade and the fourth blade. The first protrusion may be positioned farther from the bottom face of the housing than the second protrusion.

One of the first blade or the second blade, positioned closer to the actuator, may be positioned farther from the bottom face of the housing than the second protrusion such that the one is positioned at a position beyond a displacement range of the second protrusion. Further, one of the third blade or the fourth blade, which is positioned closer to the actuator, may be positioned closer to the bottom face of the housing than the first protrusion such that the one is positioned at a position beyond a displacement range of the first protrusion.

The support structure may include support blocks that project from the bottom face of the housing, and slots defined in the support blocks. At least one of the first blade to the fourth blade is inserted into at least one slot and is fixed to at least one support block, The first blade and the third blade may be connected to a common conductor that passes through the housing. The second blade may be connected to a first conductor that passes through the housing. The common conductor and the first conductor may pass through the single inner space within the housing. The fourth blade may be connected to a second conductor that passes through the housing. The common conductor and the first conductor and the second conductor may pass through the single inner space in the housing. The support structure may have a conductor-receiving groove defined in the support block. At least one of the common conductor, the first conductor, or the second conductor passing through the housing may be received in the conductor-receiving groove.

At least one of the first to fourth blades may include a blade body. The blade body may be inserted into the slot and is fixed to the support block, and at least a portion of the blade body may be exposed out of the support block. A conductor-receiving portion may extend from the blade body. The conductor-receiving portion may receive a corresponding conductor. The corresponding conductor may pass through the conductor-receiving groove when the blade body is fixed to the support block. The corresponding conductor may be selected from the common conductor, the first conductor, and the second conductor.

The blade body may have a non-interference groove defined therein. The non-interference groove may receive a corresponding conductor and prevent the conductor from interfering with the blade body. The corresponding conductor may be received in the conductor-receiving groove and may be selected from the common conductor, the first conductor, and the second conductor.

The support structure may have a pair of the conductor-receiving grooves spaced apart by a predetermined spacing in a lengthwise direction of the blade body. One conductor-receiving groove of the pair of conductor-receiving grooves may be positioned a greater distance from the actuator than the other conductor-receiving groove thereof. The conductor-receiving portion and the non-interference groove may coincide with the one conductor-receiving groove. A further non-interference groove may be defined to coincide with the other conductor-receiving groove.

Embodiments disclosed herein provide a switch device that may include a first switch including a first blade and a second blade configured to contact or non-contact each other, the first switch being configured to be opened or closed based on a contact or non-contact between the first blade and the second blade; a second switch including a third blade and a fourth blade configured to contact or non-contact each other, the second switch being configured to be opened and closed based on a contact or non-contact between the third blade and the fourth blade; a housing that accommodates the first switch and the second switch therein; and an actuator disposed in the housing and actuated to selectively open and close the first switch and the second switch. Each of the first to fourth blades may be connected to at least one of a common conductor, a first conductor, or a second conductor that passes through the housing. The common conductor, the first conductor, and the second conductor may extend at a same vertical level in the housing and be connected to at least one of the first to fourth blades in a single inner space of the housing.

The housing may include a bottom face on which the first switch, the second switch, and the actuator may be installed, and a sidewall that surrounds the bottom face. Notches may be defined through the sidewall. The notches may define passages through which the common conductors, the first conductor, and the second conductor pass through the housing.

Embodiments disclosed herein provide a cooking appliance that may include a knob configured to be rotatable; a rotational shaft configured to rotate in conjunction with the rotation of the knob; and a switch device connected to the rotational shaft to allow an actuator to be actuated in conjunction with the rotation of the rotational shaft. The switch device may include the switch device according to embodiments discussed above.

The cooking appliance may further include a valve configured to be opened and closed based on the rotation of the rotational shaft to control gas supply to a burner; and an ignition device configured to ignite the gas supplied to the burner. The first switch may be closed when the rotational shaft is in a position to open the valve. The ignition device may be activated using power supplied thereto when the first switch is closed.

The cooking appliance may further include a display device or display configured for indicating whether the valve is open. The second switch may be closed when the rotational shaft is in a position to open the valve. The display device may be activated using power supplied thereto when the second switch is closed.

The switch device according to embodiments may provide a multi-switching function while having a compact structure and being manufactured at a low manufacturing cost. Further, a cooking appliance including the switching device may be realized.

Moreover, according to embodiments, an increase in manufacturing costs of the cooking appliance including the switch device may be suppressed. Further, an increase in volume occupied by the switch device in the cooking appliance may be suppressed. This may suppress an increase in the manufacturing costs of the cooking appliance due to the addition of the switch device. Control of operations of various functional units for convenient use of the cooking appliance may be executed effectively with the single switch device.

Moreover, according to embodiments, the switch device may reduce the number of conductors required to realize the switch device. This allows the switch device to be manufactured at a low manufacturing cost while having a more compact structure. Further, there is an advantage that wirings in the cooking appliance in which the switch device is installed may be more simply configured.

Moreover, according to embodiments, the switch device may have a configuration in which the switch device is connected to three conductors, and not to four conductors; a configuration in which the first blade and the third blade are integrally connected to form a single integration thereof; and a configuration in which integration of the first blade and the third blade shares the single conductor-receiving portion. Thus, as the number of manufacturing process steps is reduced, the process of fabricating the switch device may be very effectively simplified. Further, this may lower a risk probability that the blades will be removed, due to the reduced number of engaged portions with the blades, thereby reducing the risk of product failure.

In the above description, numerous specific details are set forth in order to provide a thorough understanding. Embodiments may be practiced without some or all of these specific details. Examples of various embodiments have been illustrated and described above. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A switch device, comprising:

a first switch including a first blade and a second blade, wherein the first switch is configured to be opened or closed based on contact or non-contact between the first blade and the second blade;

a second switch including a third blade and a fourth blade, wherein the second switch is configured to be opened and closed based on contact or non-contact between the third blade and the fourth blade;

a housing that accommodates the first switch and the second switch therein; and an actuator disposed in the housing and actuated to selectively open and close the first switch and the second switch, wherein the second blade is connected to a first conductor that passes through the housing, wherein the fourth blade is connected to a second conductor that passes through the housing, wherein both the first blade and the third blade are connected to a common conductor that passes through the housing, and wherein the first blade and the third blade are integrally coupled with each other to form a single integrated blade including the first blade and the third blade.

2. A switch device, comprising:

a first switch including a first blade and a second blade configured to contact or not contact each other, wherein the first switch is configured to be opened or closed based on contact or non-contact between the first blade and the second blade;

a second switch including a third blade and a fourth blade configured to contact or not contact each other, wherein the second switch is configured to be opened and closed based on contact or non-contact between the third blade and the fourth blade;

a housing that accommodates the first switch and the second switch therein; and an actuator disposed in the housing and actuated to selectively open and close the first switch and the second switch, wherein both the first switch and the second switch are positioned in a single inner space within the housing, wherein the second blade is connected to a first conductor that passes through the housing, wherein the fourth blade is connected to a second conductor that passes through the housing, wherein both the first blade and the third blade are connected to a common conductor that passes through the housing, and wherein all of the common conductor, the second conductor, and the first conductor pass through the single inner space.

3. The switch device of claim 2, wherein the common conductor, the first conductor, and the second conductor are positioned at a same vertical level within the housing, wherein the first blade and the third blade are positioned at different vertical levels within the housing, and wherein the second blade and the fourth blade are positioned at different vertical levels in the housing.

4. The switch device of claim 3, wherein the second blade and the fourth blade are positioned so as to be coplanar, and wherein the first blade and the third blade are positioned so as to be coplanar.

5. The switch device of claim 2, wherein all of the common conductor, the first conductor, the second conductor, the first switch, and the second switch are fixedly supported by a support structure disposed on a same plane as a mounting plane for the actuator and are positioned in the single inner space.

6. The switch device of claim 5, wherein the support structure includes support blocks that project from the bottom face of the housing, and slots defined in the support blocks, and wherein at least one of the first blade to the fourth blade is inserted into at least one slot and is fixed to at least one support block.

7. The switch device of claim 6, wherein the support structure has a conductor-receiving groove defined in the support block, wherein at least one of the common conductor, the first conductor, or the second conductor that passes through the housing is received in the conductor-receiving groove.

8. The switch device of claim 7, wherein at least one of the first to fourth blades includes a blade body, wherein the blade body is inserted into the slot and is fixed to the support block, and at least a portion of the blade body is exposed out of the support block, wherein a conductor-receiving portion extends from the blade body, wherein the conductor-receiving portion receives a corresponding conductor, wherein the corresponding conductor passes through the conductor-receiving groove when the blade body is fixed to the support block, and wherein the corresponding conductor is selected from the common conductor, the first conductor, and the second conductor.

9. The switch device of claim 8, wherein the first blade and the third blade are integrally connected with each other to form a single integrated blade, wherein the single integrated blade is connected to the common conductor, and wherein one of the first blade or the third blade includes the conductor-receiving portion for receiving the common conductor to allow the single integrated blade to connect to the common conductor.

10. The switch device of claim 8, wherein the blade body includes a non-interference groove defined therein, wherein the non-interference groove receives a corresponding conductor and prevents the conductor from interfering with the blade body, and wherein the corresponding conductor is received in the conductor-receiving groove and is selected from the common conductor, the first conductor, and the second conductor.

11. The switch device of claim 10, wherein the support structure includes a pair of the conductor-receiving grooves spaced apart by a predetermined spacing in a lengthwise direction of the blade body, wherein a first conductor-receiving groove of the pair of the conductor-receiving grooves is positioned a greater distance from the actuator than a second conductor-receiving groove, wherein the blade body having the conductor-receiving portion coinciding with the first conductor-receiving groove has the non-interference groove, and wherein the non-interference groove is defined to coincide with the second conductor-receiving groove.

12. The switch device of claim 2, wherein the first blade and the third blade are integrally coupled with each other to form a single integrated blade including the first blade and the third blade.

13. The switch device of claim 12, wherein the single integrated blade is connected to the common conductor, where one of the first blade or the third blade is directly connected to the common conductor.

14. The switch device of claim 13, wherein the common conductor is positioned at a first side in a first direction of the housing, wherein the first conductor and the second conductor are positioned at a second side in the first direction of the housing, wherein the actuator is positioned between the first side and the second side in the first direction of the housing, wherein the first conductor is positioned a greater distance from the common conductor than the second conductor, wherein the second blade includes:

a blade body having a length that extends in the first direction and defining a contact face to contact the first blade; and a conductor-receiving portion that receives the first conductor to allow the blade body to connect to the first conductor, wherein the blade body is located at a vertical level higher than a vertical level of the second conductor from a bottom face of the housing, and wherein a combination of the conductor-receiving portion and the blade body defines an inverted-L shape.

15. The switch device of claim 14, wherein the second blade is positioned at a higher vertical level from the bottom face of the housing than the fourth blade, wherein the first blade is positioned at a higher vertical level from the bottom face of the housing than the third blade, wherein the single integrated blade is constructed such that both a blade body defining a portion of the first blade and a blade body defining a portion of the third blade are connected to the single conductor-receiving portion connected to the common conductor, and wherein a cut-out is defined between the blade body defining a portion of the first blade and the blade body defining a portion of the third blade.

16. The switch device of claim 15, wherein the second blade and the fourth blade are spaced apart from each other in a second direction orthogonal to the first direction, and wherein the blade body defining a portion of the first blade and the blade body defining a portion of the third blade are spaced apart from each other by the spacing between the second blade and the fourth blade.

17. The switch device of claim 16, wherein all of the first blade, the second blade, the third blade, and the fourth blade are positioned at one of opposite sides in the second direction of the housing, and wherein the actuator is positioned between the opposite sides in the second direction of the housing.

18. A cooking appliance, comprising:

a knob configured to be rotatable;

a rotational shaft configured to rotate in conjunction with rotation of the knob; and a switch device connected to the rotational shaft to allow an actuator to be actuated in conjunction with the rotation of the rotational shaft, wherein the switch device includes:

a first switch including a first blade and a second blade configured to contact or not contact each other, wherein the first switch is configured to be opened or closed based on contact or non-contact between the first blade and the second blade;

a second switch including a third blade and a fourth blade configured to contact or not contact each other, wherein the second switch is configured to be opened and closed based on contact or non-contact between the third blade and the fourth blade;

a housing that accommodates the first switch and the second switch therein; and the actuator disposed in the housing and actuated to selectively open and close the first switch and the second switch, wherein both the first switch and the second switch are positioned in a single inner space within the housing, wherein the second blade is connected to a first conductor that passes through the housing, wherein the fourth blade is connected to a second conductor that passes through the housing, wherein both the first blade and the third blade are connected to a common conductor passing through the housing, and wherein all of the common conductor, the second conductor, and the first conductor pass through the single inner space.

19. The cooking appliance of claim 18, further comprising:

a valve configured to be opened and closed based on the rotation of the rotational shaft to control gas supply to a burner;

an ignition device configured to ignite the gas supplied to the burner; and a display configured to indicate whether the valve is open, wherein the first switch is closed when the rotational shaft is in a position to open the valve, wherein the ignition device is activated using power supplied thereto when the first switch is closed, wherein the second switch is closed when the rotational shaft is in the position to open the valve, and wherein the display is activated using power supplied thereto when the second switch is closed.

* * * * *